US007777765B2

(12) United States Patent
Adachi et al.

(10) Patent No.: US 7,777,765 B2
(45) Date of Patent: Aug. 17, 2010

(54) LIQUID CRYSTAL DISPLAY DEVICE AND METHOD FOR DRIVING LIQUID CRYSTAL DISPLAY DEVICE

(75) Inventors: Takako Adachi, Matsusaka (JP); Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 930 days.

(21) Appl. No.: 11/078,375

(22) Filed: Mar. 14, 2005

(65) Prior Publication Data

US 2005/0200619 A1 Sep. 15, 2005

(30) Foreign Application Priority Data

Mar. 15, 2004 (JP) ..... 2004-073500
Dec. 21, 2004 (JP) ..... 2004-370202

(51) Int. Cl.
*G09G 5/10* (2006.01)

(52) U.S. Cl. ..... 345/690

(58) Field of Classification Search ..... 345/87–104, 345/690, 694, 698; 348/674; 382/167
See application file for complete search history.

(56) References Cited

U.S. PATENT DOCUMENTS 5,737,032 A * 4/1998 Stenzel et al. ..... 348/649
5,764,216 A * 6/1998 Tanaka et al. ..... 345/87
5,844,533 A * 12/1998 Usui et al. ..... 345/89
5,963,186 A * 10/1999 Hughes et al. ..... 345/94
6,094,187 A * 7/2000 Jones et al. ..... 345/690
6,380,917 B2 * 4/2002 Matsueda et al. ..... 345/89
6,559,837 B1 * 5/2003 Lasneski et al. ..... 345/204
6,806,862 B1 * 10/2004 Zhang et al. ..... 345/103
6,937,224 B1 8/2005 Miyachi
6,956,555 B2 * 10/2005 Kyomoto ..... 345/102
2001/0043183 A1 * 11/2001 Ishikawa et al. ..... 345/89
2002/0057249 A1 5/2002 Tashiro et al.
2002/0140652 A1 10/2002 Suzuki et al.
2003/0058229 A1 3/2003 Kawabe et al.
2003/0169247 A1 * 9/2003 Kawabe et al. ..... 345/204

(Continued)

FOREIGN PATENT DOCUMENTS

JP 2001-60078 3/2001

(Continued)

*Primary Examiner*—Amr Awad
*Assistant Examiner*—Michael Pervan
(74) *Attorney, Agent, or Firm*—Harness, Dickey & Pierce, P.L.C.

(57) ABSTRACT

A liquid crystal display device, including (a) a liquid crystal panel for carrying out display by voltage application to pixels, each of which has a liquid crystal layer, and (b) a driving circuit for applying, within one frame time, (i) voltages that respectively correspond with image signals and (ii) a voltage that corresponds with a clear command signal, to the pixels of said liquid crystal panel, is arranged such that said driving circuit includes a combination detector circuit for generating, by looking up an OS parameter table, corrected image signals according to combination of first image signals for a preceding frame time and second image signals for a present frame time, the corrected image signals thus generated causing liquid crystal orientation in the pixels to be transited from initial orientation of the present frame time to orientation indicated by the second image signals. With this arrangement, it is possible to display gray scale levels of the image signals, thereby realizing display of a moving image of high image quality.

7 Claims, 14 Drawing Sheets

U.S. PATENT DOCUMENTS

| | | | |
|---|---|---|---|
| 2004/0001054 | A1 | 1/2004 | Nitta et al. |
| 2005/0237294 | A1 | 10/2005 | Miyachi |
| 2006/0092113 | A1 | 5/2006 | Nitta et al. |

FOREIGN PATENT DOCUMENTS

| | | | |
|---|---|---|---|
| JP | 2002-107694 | | 4/2002 |
| JP | 2002-149132 | A | 5/2002 |
| JP | 2002-297104 | | 10/2002 |
| JP | 2003-66918 | A | 3/2003 |
| JP | 2003-280599 | | 10/2003 |
| JP | 2004-253827 | A | 9/2004 |

* cited by examiner

FIG. 3

| | | GRAY SCALE LEVEL OF IMAGE SIGNAL FOR PRESENT FRAME | | | | | | | | |
|---|---|---|---|---|---|---|---|---|---|---|
| | | 0 | 32 | 64 | 96 | 128 | 160 | 192 | 224 | 255 |
| GRAY SCALE LEVEL OF IMAGE SIGNAL FOR PRECEDING FRAME | 0 | 0 | 61 | 152 | 184 | 201 | 214 | 229 | 247 | 255 |
| | 32 | 0 | 48 | 134 | 169 | 194 | 209 | 224 | 243 | 255 |
| | 64 | 0 | 32 | 113 | 150 | 178 | 200 | 218 | 237 | 255 |
| | 96 | 0 | 24 | 99 | 144 | 173 | 198 | 216 | 236 | 255 |
| | 128 | 0 | 19 | 91 | 140 | 169 | 196 | 215 | 236 | 255 |
| | 160 | 0 | 12 | 79 | 134 | 163 | 194 | 214 | 235 | 255 |
| | 192 | 0 | 7 | 72 | 130 | 159 | 192 | 213 | 235 | 255 |
| | 224 | 0 | 0 | 62 | 119 | 152 | 186 | 211 | 234 | 255 |
| | 255 | 0 | 0 | 54 | 112 | 149 | 184 | 210 | 233 | 255 |

FIG. 4

| | | GRAY SCALE LEVEL OF IMAGE SIGNAL FOR PRESENT FRAME | | | | |
|---|---|---|---|---|---|---|
| | | 0 | 32 | 64 | ···· | 255 |
| GRAY SCALE LEVEL OF IMAGE SIGNAL FOR PRECEDING FRAME | 0 | A | B | | | |
| | 32 | D | C | | | |
| | 64 | | | | | |
| | ⋮ | | | | | |
| | 255 | | | | | |

Conventional Art

Conventional Art

LIQUID CRYSTAL DISPLAY DEVICE AND METHOD FOR DRIVING LIQUID CRYSTAL DISPLAY DEVICE

This Nonprovisional application claims priority under 35 U.S.C. §119(a) on Patent Application No. 073500/2004 and No. 370202/2004 filed in Japan respectively on Mar. 15, 2004 and Dec. 21, 2004, the entire contents of which are hereby incorporated by reference.

FIELD OF THE INVENTION

The present invention relates to a liquid crystal lay device, particularly to a liquid crystal display device for displaying a moving image.

BACKGROUND OF THE INVENTION

In recent years, liquid crystal display devices are widely used: For example, the liquid crystal display device is used for personal computers, word processors, amusement machines, televisions and the like. The liquid crystal display devices is, however, a holding type display device in which light emitted for display (hereinafter, this light is referred to as a display light ray) changes continuously as time passes, unlike an impulse type display device such as a cathode ray tube in which a display light ray is momentary. Thus, in general, the holding type display device has a slow response time. Therefore, the holing type display device has a problem in that deterioration of an image, for example, a blur in a moving object, occurs especially when it displays a moving image. In order to display a moving image of high image quality, a method for improving a response property has been explored.

One method proposed for improving the response property is to arrange a hold type display device such as a liquid crystal display device to have a pseudo-impulse type display characteristic similar to that of the impulse-type display device. Namely, the method proposes to arrange the hold type display device such that the a display light ray is momentary or intermittent, as in the cathode ray tube.

The Japanese Laid-Open Patent Publication 66918/2003 (Tokukai 2003-66918, published on Mar. 5, 2003) discloses a display device driven in such a way that blanking data is inserted between image data and image data which are for one frame time so that the image data and the blanking data are displayed alternately within one frame time, whereby this liquid crystal display device has an impulse-type display device characteristic. This makes it possible to prevent deterioration of image quality caused by a blur in a moving image and the like, in no need of a large and complex structure (i.e. avoiding a large and complex structure).

To be more specific, the display device disclosed in Tokukai 2003-66918, as illustrated in FIG. 10, includes a circuit 102 for generating scanning data for multiple scanning, a circuit 103 for generating scanning timing for multiple scanning, and a display element array 106. The circuit 102 inserts blanking data between one-frame-time image data (image data for one frame time) supplied from an image signal source 101. The circuit 103 generates timing for driving a gate line.

As illustrated in FIG. 11, a scanning signal generated in the display device is such that a frame time 301 is divided into two periods, namely, a screen image scanning period 302 and a blanking scanning period 303. In other words, during one frame time gate line selection is carried out twice. During the screen image scanning period 302, the scanning signal generated in this display is written in two gate lines at the same time (that is, the scanning signal is supplied to the two gate lines at the same time to control the gate line in accordance with the scanning signal). In other words, the writing is carried out by two line-selection scanning. By the two line-selection scanning, G1 and G2 are selected so that the scanning signal is written into G1 and G2 at the same time; then G3 and G4 are selected so that a next image signal is written into G3 and G4 at the same time. Subsequently, the blanking data is also written into two lines at a time in the same manner by the two line-selection scanning. With this arrangement, image display and blanking display are carried out within one frame time.

In the following the writing with respect to one pixel in a display array in this arrangement is described. As illustrated in FIG. 12, a frame time 401, which is one frame time, is divided into two periods: an screen image writing period 402 (time during which image is written in) and a blanking writing period 403 (time during which blanking data is written in). A video signal is written in during the screen image writing period 402 and the blanking data is written in during a blanking writing period 403. The blanking data is close to a common-level voltage rather than a gray scale voltage for a screen image. The screen image writing period 402 has a selection period, which is indicated by a gate driving waveform 405, meanwhile the blanking writing period 403 also has a selection period, as indicated by the gate driving waveform 405. During the selection period of the screen image writing period 402, the video signal indicated by a source waveform 407 is written in the pixel and transmittance is increased as indicated by an optical response waveform 409. Then, during a selection period of the blanking writing period 403, a clear command signal illustrated by the source waveform 407 is written in the pixel and transmittance is decreased as indicated by the optical response waveform 409.

By using the driving method mentioned above, display as illustrated in FIG. 13(*a*) is possible. Namely, an original screen image 801 transmitted from the image signal source 101 is compressed to a half in a vertical direction and blanking data is written into the other half by the circuit 102. The screen image thus prepared is written, as illustrated in FIG. 13(*b*), is written into two lines at the same time in a timing of the two line-selection scanning. In this way, the screen image data and blanking data are displayed within one frame time in such a manner that a screen image response and a black response are repeated. Accordingly, it becomes possible to cause the liquid crystal display device to have a impulse-type display characteristic. This makes it possible to prevent deterioration of image quality resulting from a blur in a moving image.

Tokukai 2003-66918 also discloses a method by which an original screen image is compressed into one quarter and one frame time is divided into four. With this arrangement, a fast-response screen image (which is prepared by using a fast-response filter in order to give a screen image a fast response property: an original image is emphasized in the fast-response screen image) is written in during one quarter of a frame time. During a next one quarter of the frame time, the screen image is written in. And then, during a remaining half of the frame time blanking data is written in. In this way, a much quicker response is attained.

Furthermore, it is also described in Tokukai 2003-66918 that time taken for writing in one line is substantially halved when the same scanning is carried out line by line.

The Japanese Laid-Open Patent Publication 149132/2002 (Tokukai 2002-149132 published on May 24$^{th}$, 2002) discloses that a clear command is writing in before each subframe time, and an image signal is corrected so that the image signal has larger difference from a clear command signal level. This makes it possible to accelerate a response speed of a liquid crystal and to enhance quality of moving image display.

However, the display device disclosed in Tokukai 2003-66918, which enables a response waveform to raise abruptly from a black level by the fast-response screen image, cannot display a correct screen image if the blanking data has not written in completely. To be more specific, corresponding to an applied voltage illustrated by a dotted-line waveform in the upper part of FIG. 14, the display device has an optical response as indicated by a dotted-line waveform illustrated in the lower part of FIG. 14. In FIG. 14, it is supposed that when a voltage is shifted from a voltage level corresponding to an image signal to V0H corresponding to a clear command signal, polarity of the voltage is inverted. (In FIG. 14, voltages corresponding to transmittance Tx are labeled as follows: VxH stands for a voltage at +driving (i.e. the voltage having the positive polarity) and VxL stands for a voltage at −driving (i.e. the voltage having the negative polarity).)

In other words, the display device in which the blanking data is displayed as disclosed in Tokukai 2003-66918 is based on premises that transmittance is in a steady state at T0 during a clear command signal scanning period 33*a* as illustrated by a solid line after liquid crystal transmittance has become Ta as a result of the voltage VaL corresponding to a video signal of a preceding frame during an image signal scanning period 32*a*. Accordingly when the voltage VxH corresponding to the present screen image is inputted during an image signal scanning period 32*b*, a voltage Vx'H is applied during a time in which the video signal is written in, the voltage Vx'H changing the transmittance of the liquid crystal from transmittance T0 to transmittance Tx that corresponds to the video signal Vx, However, in the reality, because the liquid crystal response speed is slow, a transmittance waveform does not reach T0 during the clear command signal scanning period as illustrated by the dotted line (it becomes T0' that is higher than T0) and the waveform reaches transmittance Tx" during the image signal scanning period 32*b*, the transmittance Tx" being higher than the target transmittance Tx.

Further, in the case mentioned above, even though the voltage V0 of the clear command signal is constant (VoH or VoL is applied as the voltage V0 depending on the polarity inversion), a value of transmittance T0' of the liquid crystal at the point when writing in a next signal starts varies in various ways depending on the video signal Va of the preceding frame time. Thus, the voltage Vx' that produces transmittance Tx varies according to the video signal Vx of a preceding frame. Therefore, it is impossible to display a gray scale of the inputted screen image signal by the conventional method by which a constant voltage is given according to the video signal Vx, a correct gray scale and it becomes impossible to carry out moving image display of high image quality.

Again in the liquid crystal display device disclosed in Tokukai 2002-149132, the screen image signal is based on premises that an initial liquid crystal state of a frame time is uniformed by the clear command signal written in. Thus, the liquid crystal display device does not suppose the case in which a desired uniform transmittance is not attained in a pixel due to the slow liquid crystal response speed even if the voltage corresponding to the clear command signal is applied. When the liquid crystal state is not initially in the uniformed state in the way mentioned above, a voltage applied will not be the voltage that produces desired transmittance. As a result, the image accurately representing the original image signal cannot be displayed.

SUMMARY OF THE INVENTION

The present invention is accomplished in consideration of the problem mentioned above and an object of the present invention is to provide a liquid crystal display device that carries out moving image display of high image quality.

In order to solve the problem mentioned above, a liquid crystal display device according to the present invention including (a) a liquid crystal panel for carrying out display by voltage application to pixels, each of which has a liquid crystal layer, and (b) a driving circuit for applying, within one frame time, (i) voltages that respectively correspond with image signals and (ii) a voltage that corresponds with a clear command signal, to the pixels of said liquid crystal panel, is arranged such that the driving circuit includes a correcting section for generating corrected image signals according to combination of first image signals for a preceding frame time and second image signals for a present frame time, the corrected image signals thus generated causing liquid crystal orientation in the pixels to be transited from initial orientation of the present frame time to orientation indicated by the second image signals.

Here the "image signal" mentioned above is a signal obtained by dividing a video signal of the display into units by which the signal is supplied to the pixel. The "image signal" indicates one gray scale level. The driving circuit applies, to the pixel, the voltage that makes the liquid crystal orientation that displays a gray scale level of this image signal in the liquid crystal layer. In this way, the gray scale level of the image signal is displayed thereby displaying on the liquid crystal panel the screen image corresponding to the video signal. The display is carried out by applying, to each pixel, different voltages that correspond to the image signals which are different in each one frame time, and changing the voltages in the pixel of the liquid crystal panel in this way. Moreover, the clear command signal at the same voltage is supplied to all pixels in order to clear the image signal.

"A corrected image signal which carries out transition . . . from initial liquid crystal alignment of the present frame time to liquid crystal alignment corresponding to the second image signal" indicates a signal which gives an instruction to apply the voltage for carrying out the transition of the liquid crystal orientation in the pixels to be transited from the initial orientation of the present frame time to the orientation indicated by the second image signals. For example, the signal may indicate the gray scale level chosen from the gray scale level indicated by the image signal, or, the signal generated may be a signal that defines voltage value corresponding directly.

On the other hand, in the liquid crystal display device, in order to improve a display quality level of a moving image, it is widely known that the image signals and the clear command signal are written in by turns. In order to do this, between the period during which the voltage corresponding to the image signals for a certain frame time are applied and the period during which the voltages corresponding to the image signals for the following frame time is applied, the voltages corresponding to clear command signals is applied. In this case, the voltages corresponding to all clear command signals cannot be applied for enough time to attain the same liquid crystal orientation after the application of the voltages corresponding to the clear command signals. Accordingly, the voltages corresponding to the image signals for the following frame time are applied to the liquid crystals having various liquid crystal orientations. This has caused a problem that an image cannot be displayed accurately.

To solve the problem, in the present invention, the transition from the initial liquid crystal orientation initially obtained in the present frame time to the liquid crystal orientation that corresponds to the second image signal is carried out accurately by applying the voltages corresponding to the corrected image signals determined in consideration of the combination of the first image signals for the preceding frame time and the second image signals for the present frame.

Namely, the liquid crystal orientation of the liquid crystal, after the application the voltages corresponding to the clear command signal, varies depending on circumstances because, for an inadequate period of time (i.e. not enough time compared with a predetermined time), the voltages corresponding to the clear command signal have been applied on the liquid crystal in the liquid crystal orientation corresponding to the first image signal of a preceding frame. In other words, the state of liquid crystal orientation after the voltage corresponding to the clear command signal is applied varies depending on the values of the first image signals of the preceding frame. Accordingly, the liquid crystal orientation certainly becomes the same after the voltages corresponding to the same image signals are applied and then the voltage corresponding to the clear command signal is applied. Thus, by generating the corrected image signal in consideration of not only the second image signal but also the first image signal, the liquid crystal orientation corresponding to the second image signal can be accurately attained.

For a fuller understanding of the nature and advantages of the invention, reference should be made to the ensuing detailed description taken in conjunction with the accompanying drawings.

BRIEF DESCRIPTION OF THE DRAWINGS

FIG. 3 is a diagram of one example of an OS parameter table according to the exemplary embodiment of the present invention.

FIG. 4 is a diagram of an OS parameter table according to the exemplary embodiment of the present invention.

FIG. 9 (b) is a diagram illustrating transmittance obtained at a time when voltage corresponding to another image signal is applied after the voltage corresponding to the certain image signal is applied, in a liquid crystal display device according to the present invention.

DESCRIPTION OF THE EMBODIMENTS

Embodiment 1

A first exemplary embodiment (exemplary embodiment 1) of the present invention is explained as follows, referring to drawings. In the exemplary embodiment, it is put that a video signal is a 60 Hz progressive signal.

Figure 1:
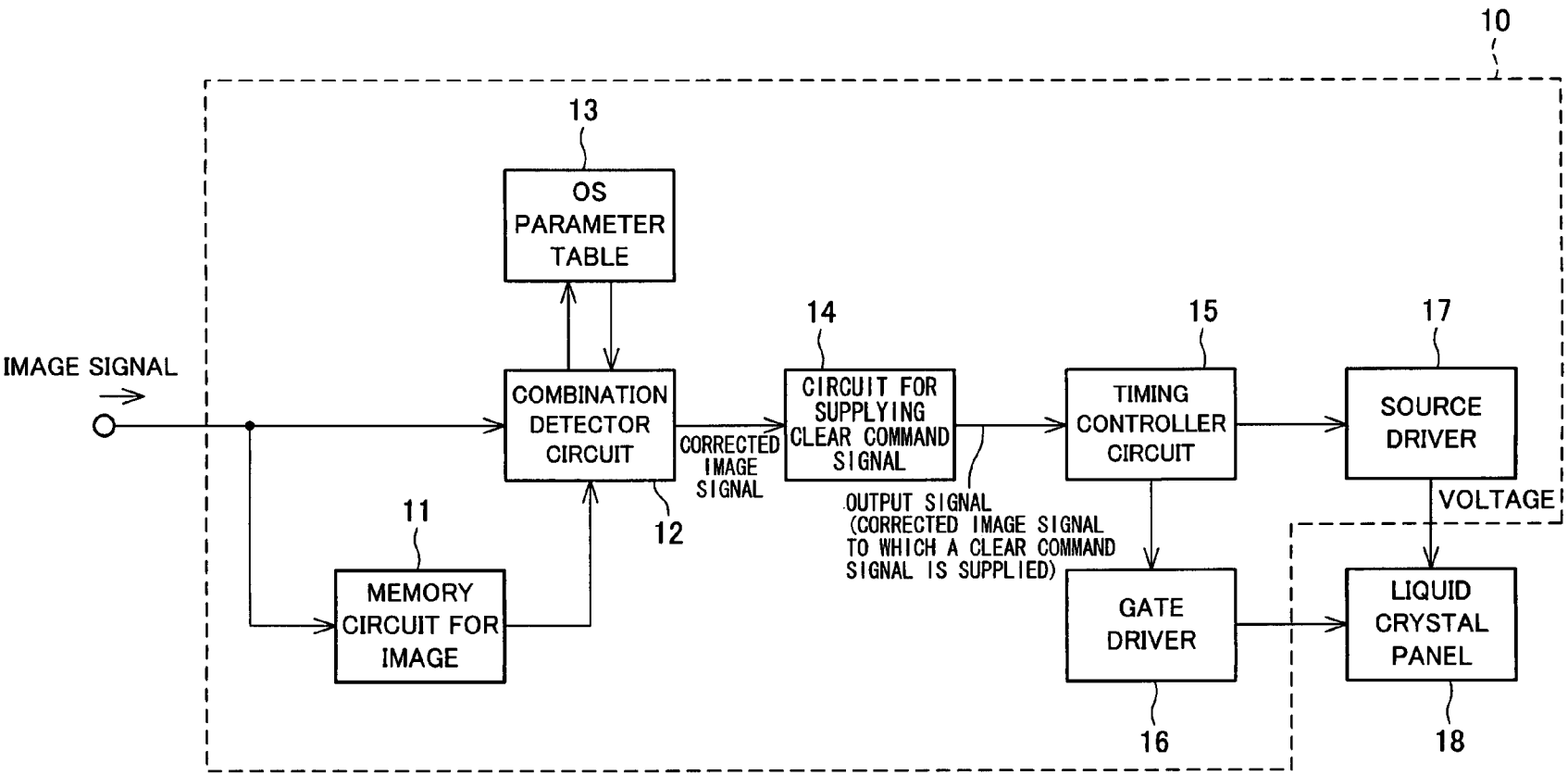
FIG. 1 is a schematic diagram of an exemplary arrangement of a liquid crystal display device according to the present invention.

FIG. 1 is a schematic diagram of an arrangement of a liquid crystal display device according to the exemplary embodiment of the present invention. In FIG. 1, sections unnecessary for explanation are omitted from the diagram.

The liquid crystal display device embodying the present invention includes a driving circuit 10 and a liquid crystal panel 18.

The driving circuit 10 includes a memory circuit 11 for storing an image therein, a combination detector circuit 12, an overshoot parameter table (an OS parameter table) 13, a circuit 14 for supplying a clear command signal, a timing controller circuit 15, a gate driver 16, and a source driver 17. The driving circuit 10 generates an image signal of an image to be displayed and provides the image signal to the liquid crystal panel 18.

The memory circuit 11 stores therein a video signal provided for a certain period of time. The combination detector circuit 12 compares, for each pixel, an image signal for a preceding frame time and an image signal for a present frame, the image signal of the preceding frame time being stored in the memory circuit 11 and the image signal of the present frame being on processing. Based on the comparison, the combination detector circuit 12 outputs a corrected image signal by detecting a gray scale level according to a combination of gray scale levels of the signals. The combination of the image signal for the preceding frame time and the image signal for the present frame and the corrected image signal corresponding to the combination are stored, in association, in the OS parameter table 13. When the combination detector circuit 12 determines an output signal, the combination detector circuit 12 looks up the OS parameter table 13. The circuit 14 adds the clear command signal to a corrected image signal outputted from the combination detector circuit 12, thereby generating an output signal. The timing controller circuit 15 divides one frame time into plural sub-frame times and provides an output signal to the gate driver 16 and the source driver 17 at appropriate timings suitable for respective sub-frames. The gate driver 16 provides voltage depending on an output signal to a gate bus line of the liquid crystal panel 18.

The source driver 17 provides, to a source bus line of the liquid crystal panel 18, voltage that corresponds to the output signal.

The liquid crystal panel 18 includes a liquid crystal layer, an electrode for applying voltage to the liquid crystal layer, and gate bus lines and source bus lines that are wirings for applying voltages to the electrode. Gate bus lines and source bus lines are arranged in a matrix and at each intersection of the gate bus lines and the source bus lines, a TFT is provided. According to an output signal supplied to the gate bus lines and the source bus lines by the gate driver 16 and the source driver 17, an arbitrary voltage is applied to a selected electrode, thereby applying the arbitrary voltage to a selected liquid crystal layer. This makes the crystal layer have transmittance corresponding to the output signal, thereby carrying out display operation.

The liquid crystal panel used in this exemplary embodiment is a homeotropic liquid crystal panel which is of a normally black (NB). The liquid crystal panel used in this exemplary embodiment includes 768 gate bus lines in an effective display area. Further, liquid crystal panel includes 1366 source bus lines for each of RGB colors in the effective display area.

Moreover, a gray scale represented by variation of peak transmittance of the liquid crystal layer in a steady state has 256 levels all together, that is, a range of gray levels 0 (black) to 255 (white). Gray scale voltages between 1.6V and 7.1V are respectively assigned to the gray scale levels. Namely, where an image signal indicates one of 256 gray scale levels ranging between gray level 0 to 255, 256 kinds of image signals (S0-S255) and the gray scale voltage corresponding to level (V0-V255) are predetermined. For example, it has been predetermined that when the image signal represents the gray level 0, the voltage V0 is applied in order to carry out display of this gray scale level. Likewise, the voltage V255 is predetermined as voltage for displaying the gray level 255.

Regarding the gray scale and the peak transmittance at the steady state, a gamma value of a gray scale/transmittance characteristic is set at 2.2. Though the gamma value is not limited to 2.2, in the case that the gamma value is set based on the gray scale level and the peak transmittance at the steady state, it is preferable to have a smaller gamma value in order to increase the precision of a part where the voltage corresponding to a high gray scale level is used because the frequency of using the voltage of the higher gray scale level (high voltage side in NB) is high when a screen image is displayed.

When an applied voltage is inverted, two voltages, +voltage and −voltage, are predetermined for each gray scale level. Namely, for V0, V0H of +voltage and V0L of −voltage are assigned and, for V255, V255H of +voltage and V255L of −voltage are assigned. Because VxH and VxL represent the same gray scale level, when the voltage is indicated by a specific numerical value Vx, both are represented by Vx. In other words, the gray scale voltage is represented as follows:

$$Vx(\text{gray scale voltage})=(VxH-VxL)/2.$$

At a room temperature, this liquid crystal panel, by a conventional overshoot driving, completes 90% or more response within 1 frame (60 Hz: 16.7 msec) for almost all gray scale transition.

Figure 2:
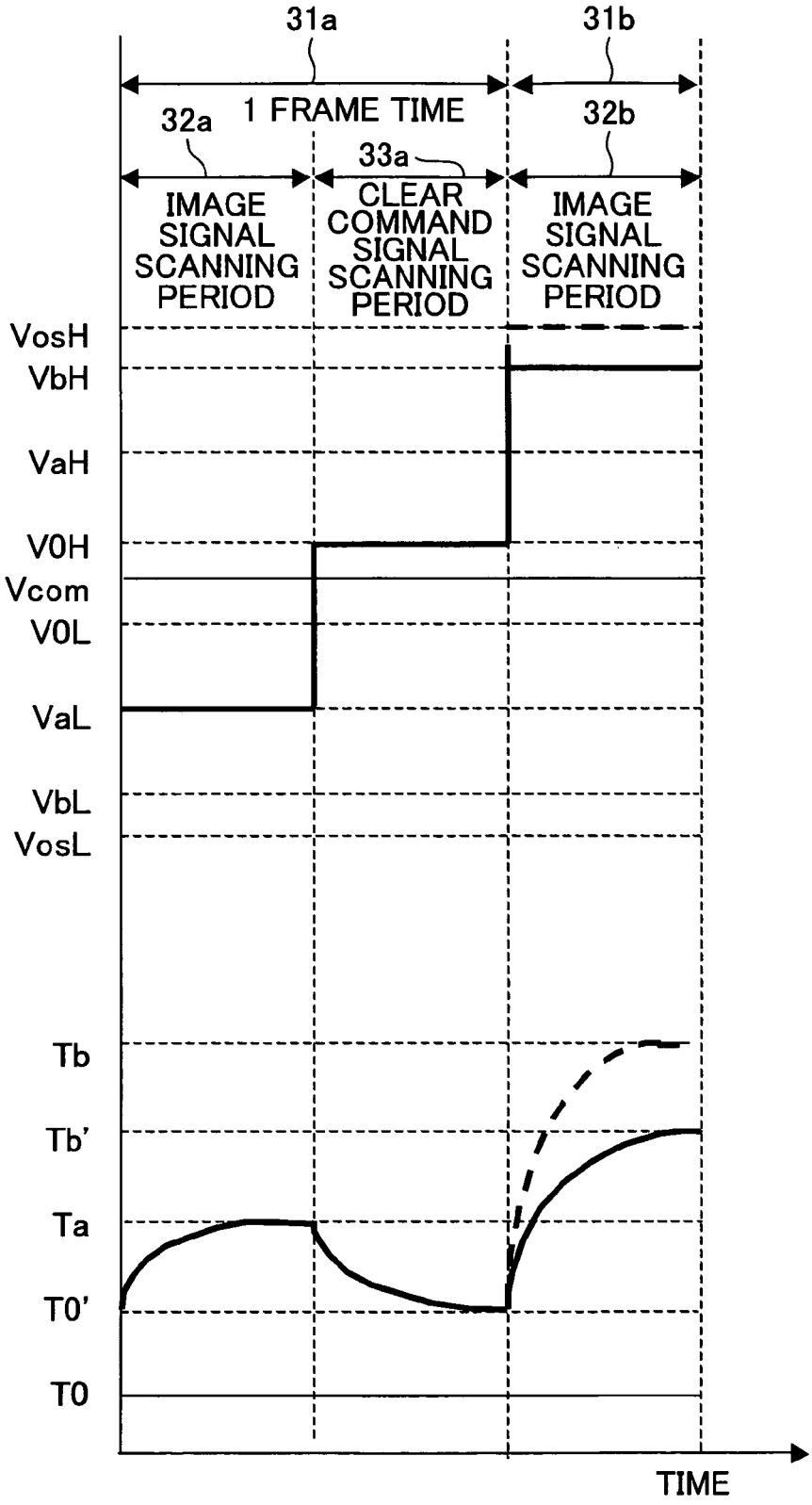
FIG. 2 is a diagram illustrating an output signal waveform and an optical response waveform in the exemplary embodiment of the present invention.

Next, referring to FIG. 2, the following explains a process of generating the corrected image signal by looking up the OS parameter table 13 in the combination detector circuit 12.

This exemplary embodiment is arranged as follows by way of example: A frame time 31 is divided into two equal subframes. During a period of substantially 8.4 msec out of an image signal scanning period 32, an arbitrary gray scale voltage corresponding to an image signal is applied and retained. During a period of substantially 8.4 msec out of a clear command signal scanning period 33, the voltage V0 corresponding to the period is applied and retained. The applied voltage here is any voltage (for example, voltages Va and Vb) that is chosen from the voltages in a range from the gray scale voltage V0 to the gray scale voltage V255 (which respectively correspond to the gray level 0 to the gray level 255. The voltage applied as the clear command signal is the gray scale voltage V0 that corresponds to the gray level 0. The peak transmittance at the steady state when voltages Va and Vb are applied is Ta and Tb respectively and the transmittance when the voltage V0 is applied is T0. In FIG. 2, the timing of inverting polarity is arranged such that the polarity is inverted at transition from the voltage corresponding to the image signal to V0 corresponding to the clear command signal.

Here, the term "peak transmittance" is used to mean a highest transmittance in the liquid crystal display device in which the voltage corresponding to the image signal and the voltage corresponding to the clear command signal are applied in an alternative manner. The highest transmittance is liquid crystal transmittance obtained just before the voltage corresponding to the clear command signal is applied. Especially, the term "Peak transmittance at a steady state" is used to mean a peak transmittance at the state in which a transmittance waveform stably goes up and down when the voltage corresponding to the image signal and the voltage corresponding to the clear command signal are applied repeatedly.

As illustrated in FIG. 2, during an image signal scanning period 32*a* of a first frame time 31*a*, voltage Val corresponding to the arbitrary image signal is applied to the liquid crystal panel and is retained, and peak liquid crystal transmittance Ta at the steady state is obtained. Then, during a clear command signal scanning period 33*a*, the voltage V0 corresponding to the clear command signal is applied and is retained. Here, because the liquid crystal response to the voltage V0 is not carried out in high speed, the liquid crystal transmittance is gradually decreased from Ta to T0. As a result, the clear command signal scanning period 33*a* ends before the liquid crystal transmittance reaches T0. Accordingly, at the end of the first frame time 31*a*, the liquid crystal transmittance becomes T0' which is transmittance between T0 and Ta. This means that transmittance at a time when voltage starts to be applied in a following second frame time 31*b* is at T0'. Therefore, it becomes necessary to adjust the applied voltage of the second image signal, taking this into consideration.

Even if, as illustrated by a solid line in FIG. 2, a gray scale voltage VbH that makes the peak transmittance at the steady state Tb is applied and retained during an image signal scanning period 32*b* of the second frame time 31*b*, the transmittance only reaches Tb' but is not be able to reach Tb at the end of the image signal scanning period 32*b* because the liquid crystal response is slow. To make the peak liquid crystal transmittance Tb, a prescribed voltage VosH that is bigger than the voltage VbH has to be applied. However, because T0' changes, an appropriate Vos cannot be detected when this deficiency of the voltage is adjusted uniformly as is described in the Japanese Laid-Open Patent Publication 66918/2003 and 149132/2002 (Tokukai 2003-66918 and 2002-149132).

Here, it can be said that, in one display device, the voltage Vos is determined depending on the peak transmittance Ta at the steady state and the peak transmittance Tb at the steady state. Namely, the voltage Vos can be figured out by the liquid crystal transmittance T0' at the end of the preceding frame time 31*a* and the target peak transmittance Tb of the present frame time 31*b*. The Transmittance T0' is determined from the transmittance Ta because the transmittance To' is the transmittance obtained after the clear command signal of a certain voltage value is written in to the pixel having the transmittance Ta and retained therein during a certain clear command signal scanning period 33*a*. Ta is determined in accordance with voltage Va of the preceding frame time 31*a*. Therefore, in the display device, the voltage Vos can be figured out by the voltage Va and the voltage Vb.

Therefore, the voltage Vos is set for this display device as follows: Voltage most appropriate for attaining a gray scale transition pattern for transiting liquid crystal orientation from an initial orientation obtained initially in the present frame time (transmittance T0') to an orientation (transmittance Tb) indicated by an image signal of the present frame time (gray scale voltage Vb) is measured and determined. The determination of the most appropriate voltage is carried out according to combination of gray scale levels of the preceding image signal and the present image signal (the combination of the gray scale voltage Va and the gray scale voltage Vb). As data of OS parameter, the thus determined most appropriate voltage is stored in the OS parameter table 13. In this way, the most appropriate voltage Vos can be obtained accurately and easily.

Figure 9:
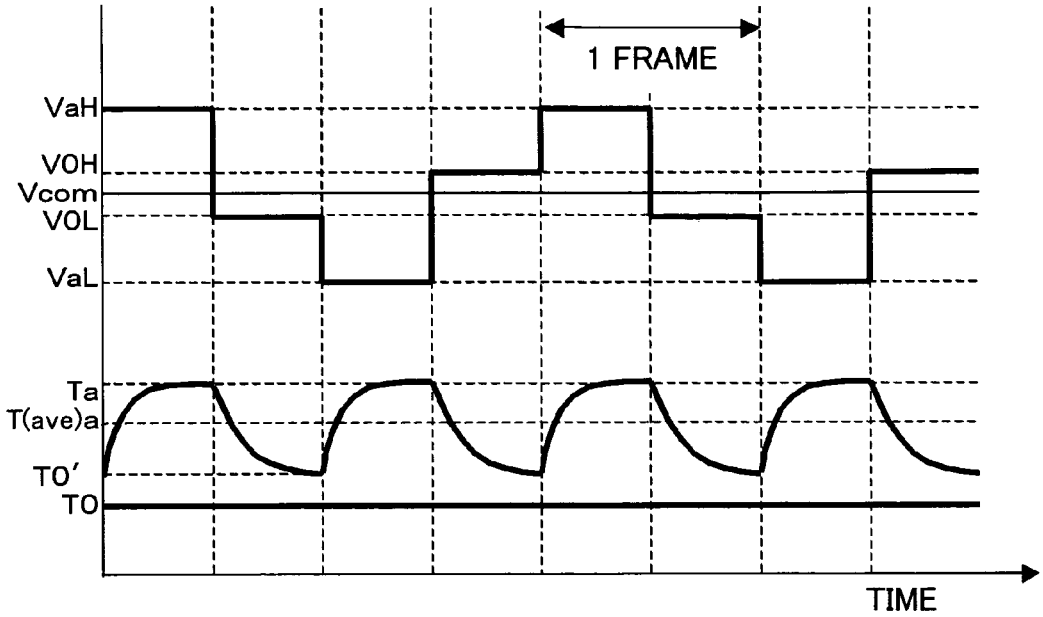
FIG. 9(*a*) is a diagram illustrating transmittance obtained at a time when voltage corresponding to a certain image signal is applied plural times to the liquid crystal display device according to the present invention.
Figure 9:
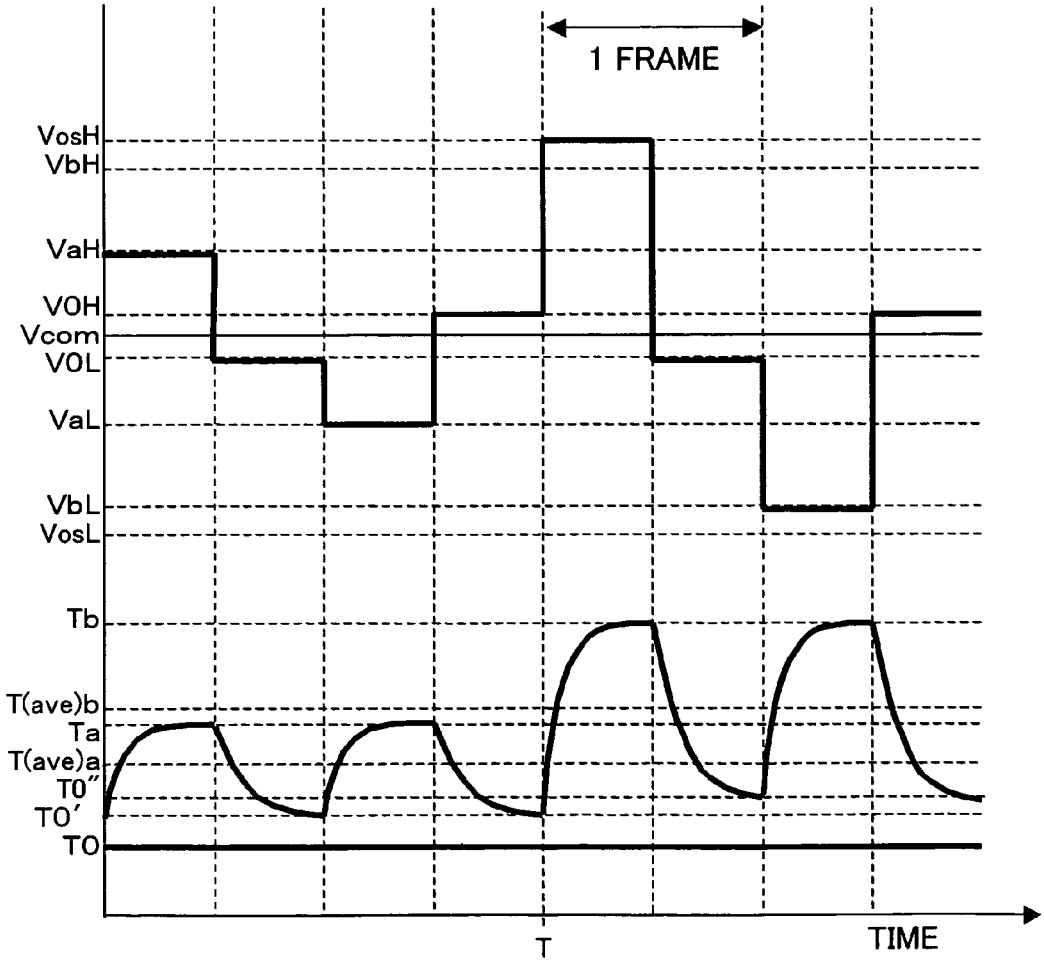
Figure 10:
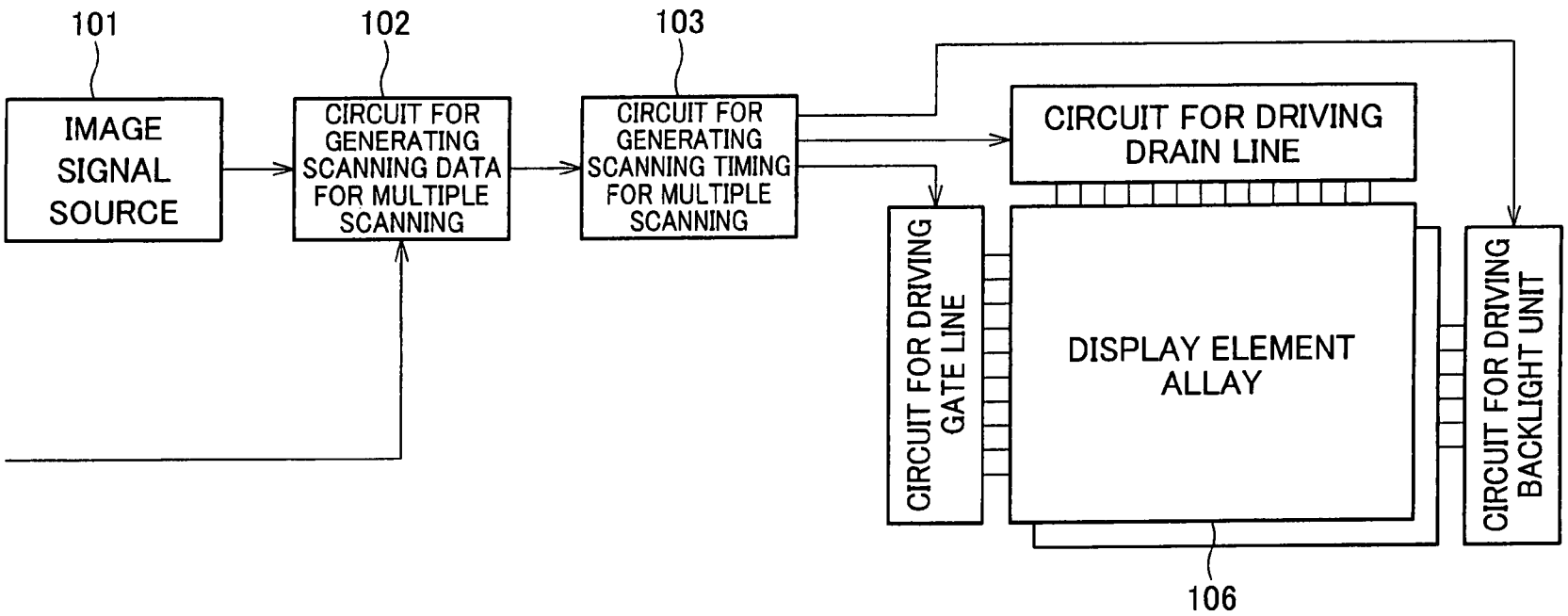
FIG. 10 is a block diagram of a system according to a liquid crystal display device of a conventional art.
Figure 11:
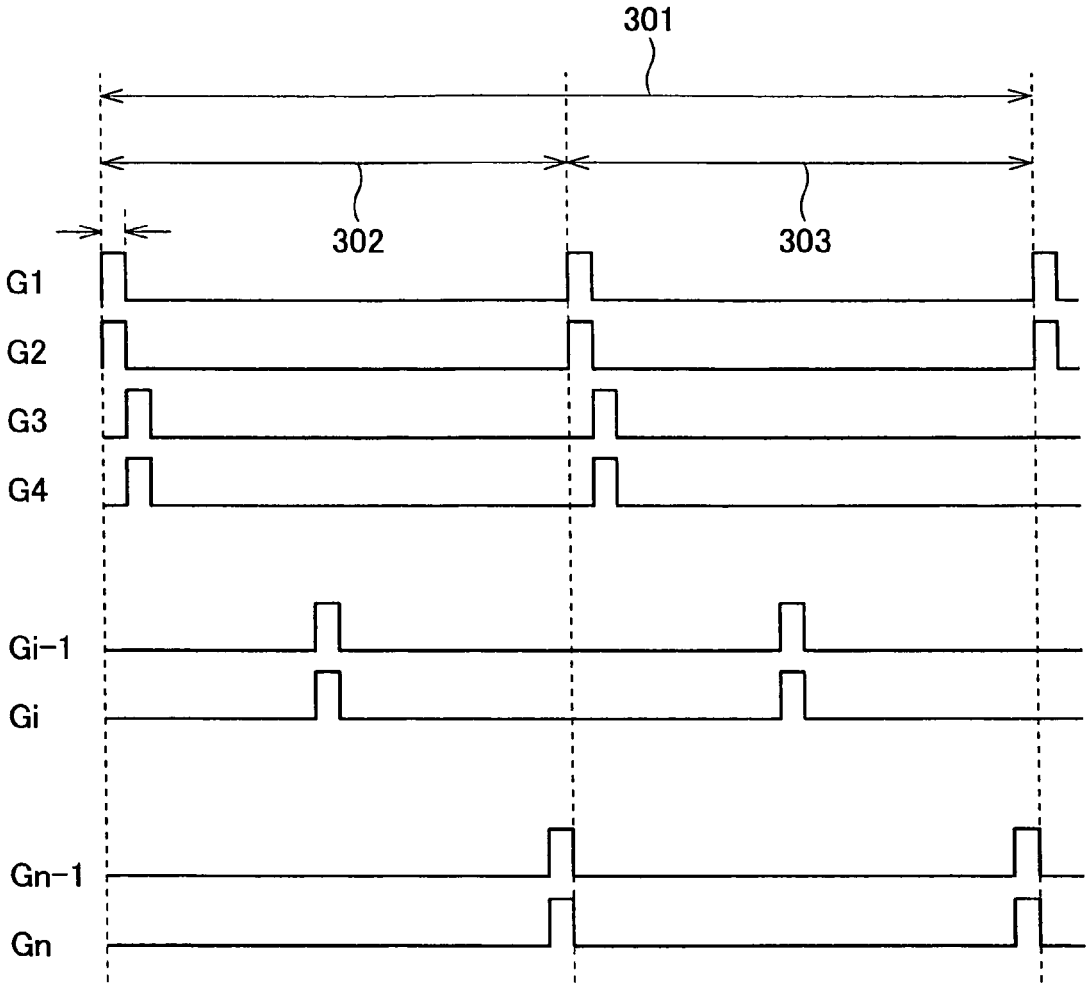
Conventional Art FIG. 11
FIG. 11 is a timing chart of a pulse assigning a gate in a liquid crystal display device of a conventional art.
Figure 12:
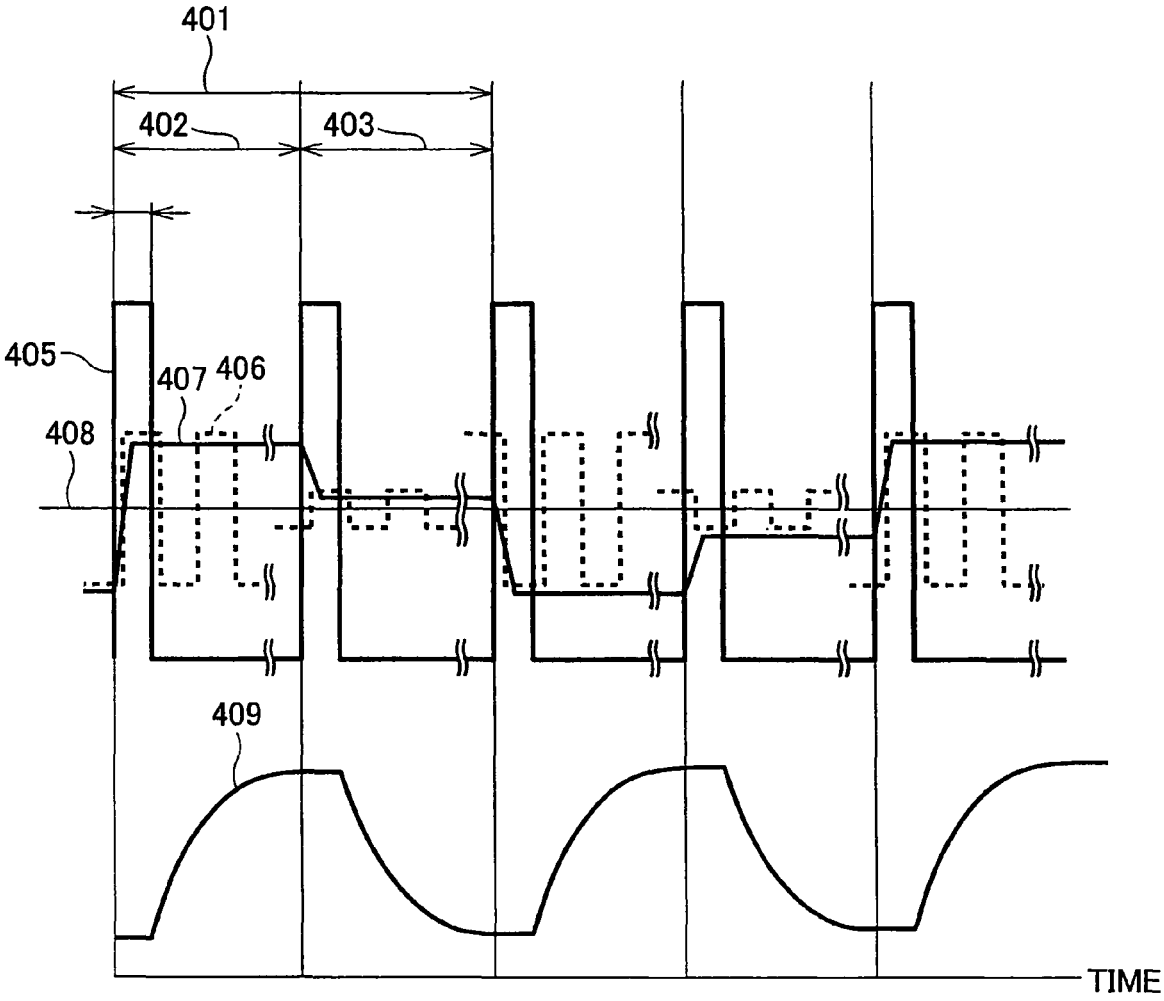
Conventional Art FIG. 12
FIG. 12 illustrates signal line driving waveforms and an optical response waveform of a display element in a liquid crystal display device of a conventional art.
Figure 13:
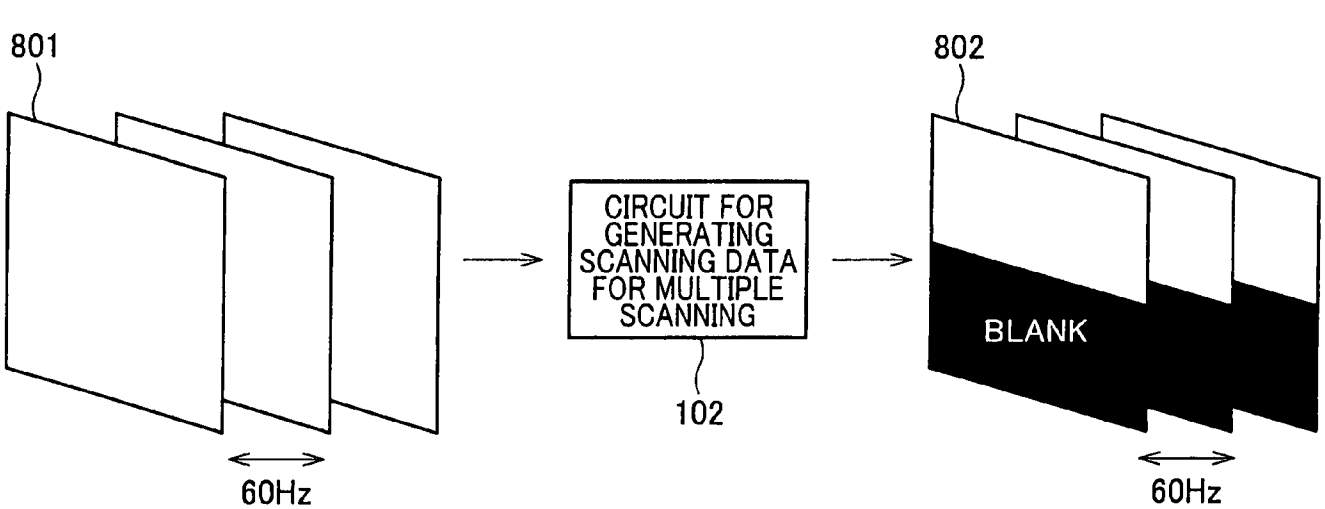
FIGS. 13(*a*) and 13(*b*) are schematic diagrams of processes for generating screen image data in a liquid crystal display device of a conventional art.
Figure 13:
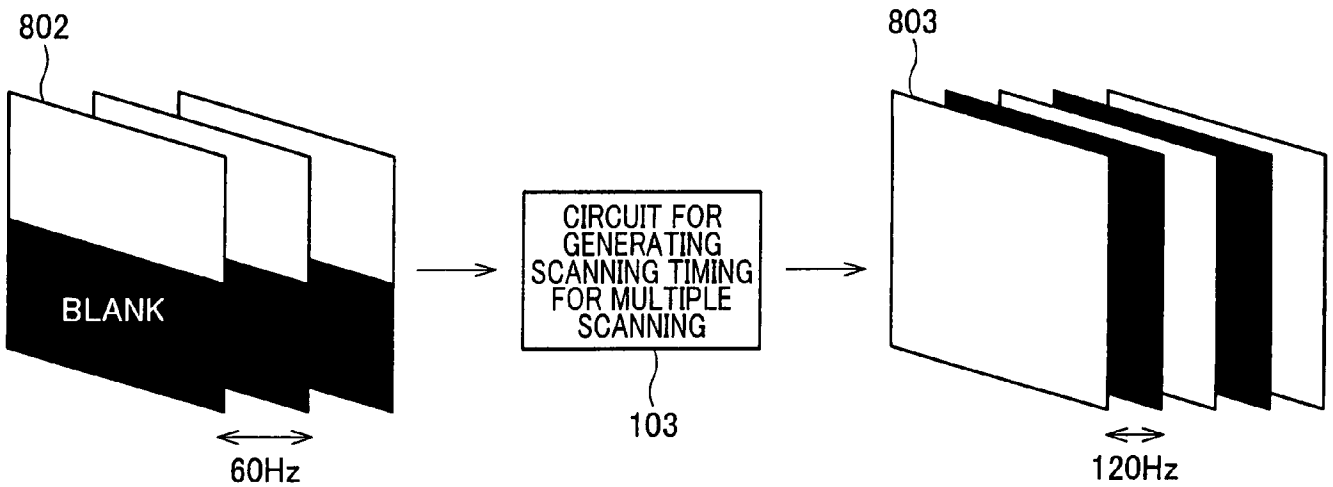
Figure 14:
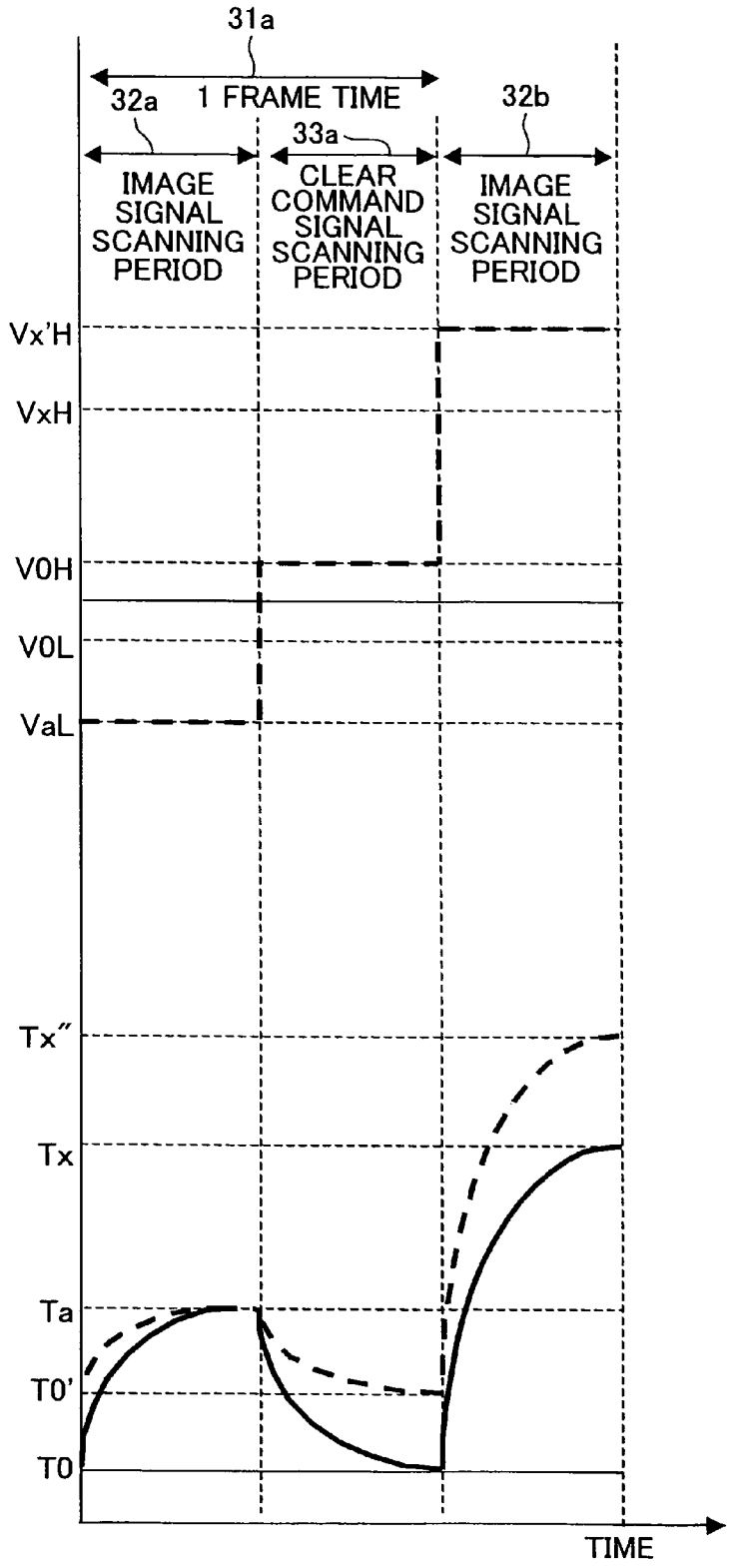
Conventional Art FIG. 14
FIG. 14 is a diagram of a waveform of an output signal and an optical response waveform in the liquid crystal display device of the conventional art.

The determination of the OS parameter is carried out in such a manner that the OS parameter is figured out by measuring the gray scale level corresponding to the voltage Vos so that the transmittance Tb corresponding to the image signal in the present frame time becomes the peak transmittance as illustrated in FIG. 9(*b*).

The OS parameter table 13 in FIG. 3 is a parameter table in a form of a 9×9 matrix for showing combinations of 9 gray scale levels. Each of the 9 gray scale levels respectively represents 32 gray scale levels of 256 gray scale levels. All the numerical values in the matrix denote gray scale levels. According to this gray scale level the voltage of a signal is determined. For example, according to this, when the preceding image signal has the gray level 32 and the present image signal has the gray level 32, the corrected image signal corresponding to the gray level 48 is to be generated.

In the OS parameter table 13, the image signal and the corrected image signal are represented by the gray scale level, but the present invention is not limited to this way for representing the signals. To represent the image signal and the corrected image signal, variation in gray scale levels, voltage value, a variation in voltage values or the like, may be stored instead of a gray scale level.

In terms of size, the OS parameter table matrix is not limited to the size of the matrix discussed here. Depending on a purpose, an appropriate size is chosen. For example, a 5×5 matrix (each gray scale level represents 64 gray scale levels respectively), a 17×17 matrix (each gray scale level represents 16 gray scale levels respectively) and the like.

By the term "Overshoot (OS)" it is meant that the comparison between the image signal at the preceding frame time and the image signal at the present frame time is carried out and the applied voltage is corrected so that the peak transmittance at the present frame time becomes desirable one.

In the OS parameter table of this exemplary embodiment, gray scale level measurement is carried out per 32 gray scale levels. That is, the measurement does not tell specifically which gray scale level the image signal is of. For a gray scale level transition pattern listed in the OS parameter table, the correction is carried out simply by looking up the OS parameter table. However, for a gray scale level transition pattern which is not stored in the table, the gray scale level is calculated by the following formula (1):

If $a \leqq b$, $$OS\ \text{parameter} = A + [(B-A)\times b + (C-B)\times a]/32, \text{ and}$$

if $a > b$, $$OS\ \text{parameter} = A + [(D-A)\times a + (C-D)\times b]/32. \qquad \text{[Formula (1)]}$$

In the formula above, the gray scale transition pattern that is not in the table (the gray scale transition pattern whose corrected image signal is to be figured out) is denoted by ($a_0$, $b_0$) where $a_0$ is a gray scale level of a preceding image signal and $b_0$ is a gray scale level of an image signal for the present frame). "a" stands for the remainder when $a_0$ is divided by 32, and "b" stands for the remainder when $b_0$ is divided by 32. Moreover, among the gray scale levels set for every 32 gray scale levels of "the gray scale level of the preceding image signal" in FIG. 4, arbitrary successive two gray scale levels are denoted by $a_1$ and $a_2$ (where $a_1<a_2$). When $a_2=255$, it is treated as $a_2=256$ for convenience. Among the gray scale levels set for every 32 gray scale levels of "the gray scale level of the present image signal," arbitrary successive two gray scale levels are denoted by $b_1$ and $b_2$ (where $b_1<b_2$). When $b_2=255$, it is treated as $b_2=256$ for convenience. Here, supposing that $a_1 \leqq a_0 < a_2$ and $b_1 \leqq b_0 < b_2$, let A, B, C and D represent the OS parameters corresponding to the following four gray scale transition patterns illustrated in FIG. 4; ($a_1$, $b_1$), ($a_1$, $b_2$), ($a_2$, $b_2$), and ($a_2$, $b_1$), where $a_1$ and $a_2$ are gray scale levels of the image signals for the preceding frame and $b_1$ and $b_2$ are gray scale levels of image signals in the present frame. For example, the OS parameters A to D illustrated in FIG. 4 are for example OS parameters for the transition pattern to transit from the gray level 10 to the gray level 20.

In the following, explained is a process by which the clear command signal is supplied to the corrected image signal thus determined in the way mentioned above and the corresponding voltage is applied to the liquid crystal panel 18.

By the circuit 14 for supplying the clear command signal, the periods for supplying all corrected image signals are shortened to half length (a period is compressed to a half) respectively. Then, between the corrected image signals for one line, the clear command signal that is the same length as the corrected image signal for one line is inserted. In this way, an output signal is generated, the output signal including the corrected image signals and the inserted clear command signals.

Figure 5:
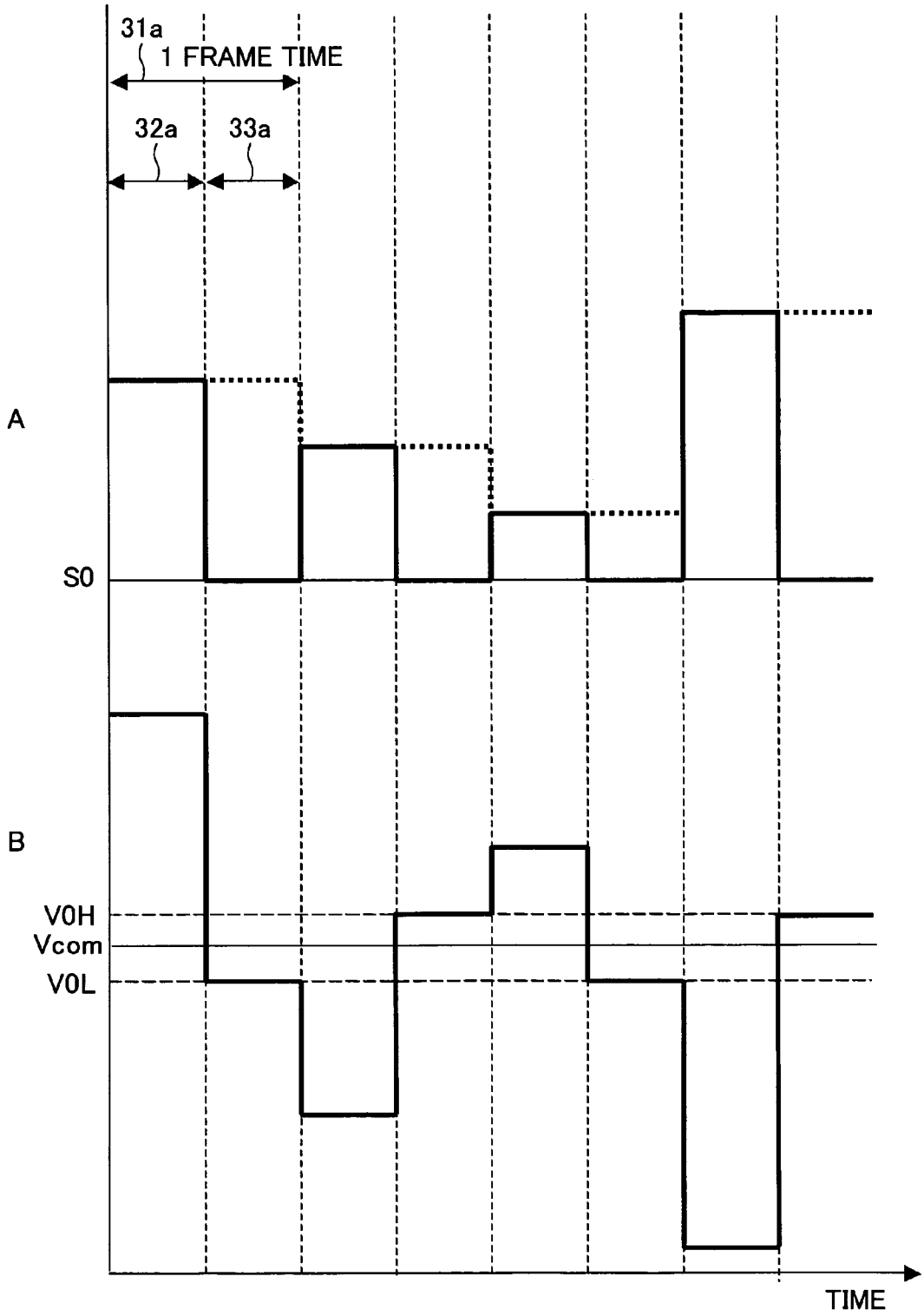
FIG. 5 is a diagram illustrating a waveform of an output signal according to the exemplary embodiment of the present invention.

FIG. 5A illustrates a corrected image signal for a certain pixel, before and after the corrected image signal is processed by the circuit 14 for supplying a clear command signal. Here, a waved dotted line in FIG. 5A represents the corrected image signal of the certain pixel for four frames. The corrected image signal is outputted by the combination detector circuit 12. A waved solid line in FIG. 5A represents the output signal outputted from the circuit 14, that is, the corrected image signal including the clear command signal S0. In the circuit 14 for supplying the clear command signal, a frame time 31*a* of the pixel is divided into two equal sections and the corrected image signal is allotted in a former half (an image signal scanning period) and the clear command signal is allotted to the latter half (a clear command signal scanning period). The vertical axis in FIG. 5A represents an arbitrary gray scale level corresponding to the image signal.

The output signal is supplied to the source driver 17 through the timing controller circuit 15 and then is outputted to each source bus line.

FIG. 5B illustrates voltage outputted from a source driver. This voltage corresponds to the output signal of the circuit 14 for the certain pixel. The voltage includes voltage (Vs) corresponding to the corrected signal and the voltage (V0) corresponding to the clear command signal. The vertical axis in FIG. 5B represents the voltage corresponding to intensity of the signal in FIG. 5A. $V_{com}$ is an opposed voltage. Regarding timing at which the polarity is inverted, it is preferable to invert the polarity between the voltage corresponding to the corrected image signal and the following voltage corresponding to the clear command signal, because it is easy to charge the pixel when V0 and $V_s$ are of the same polarity at the transition from V0 to $V_s$ (which is a gray scale voltage corresponding to the corrected image signal). This is because the variation in charge becomes small when V0 and $V_s$ are of the same polarity.

On the other hand, the timing controller circuit 15 generates a timing pulse from the output signal generated in a way explained above, and outputs to the gate driver 16. By outputting the output signal in an output timing indicated by the timing pulse, the screen image is displayed during one frame time. Here, the timing pulse is generated so that all gate bus lines from G1 to G768 can be selected respectively once during 8.4 msec which is a half of one frame time. This makes it possible to apply, to one gate bus line during one frame time, the voltage corresponding to the image scanning signal and the voltage corresponding to the clear command signal.

Figure 6:
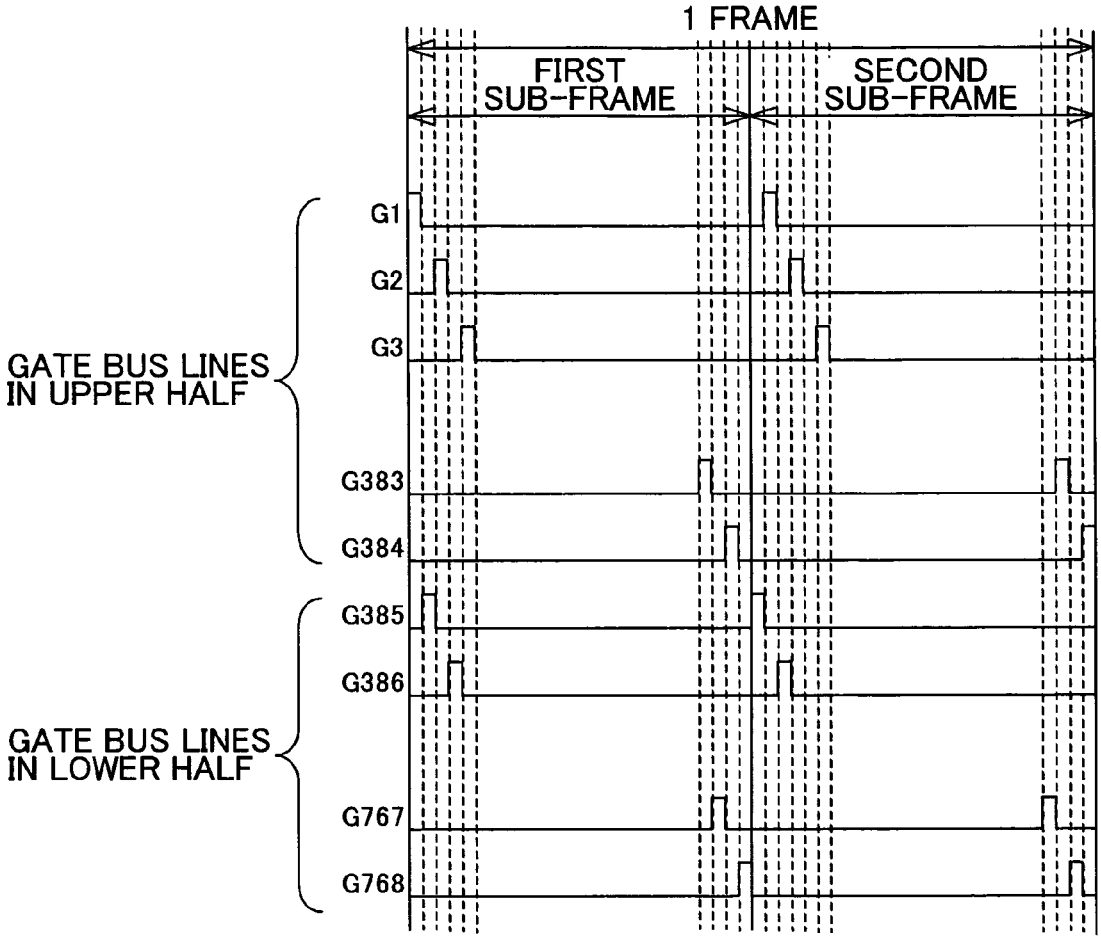
FIG. 6 is a timing chart illustrating timing of selecting a gate bus line according to the exemplary embodiment of the present invention.

To be more specific, the selection of the gate bus lines of the liquid crystal panel 18 by the gate driver 16 is carried out by applying the timing pulse outputted by the timing controller circuit 15 to the gate driver 16. FIG. 6 illustrates how to select the gate bus lines in this arrangement. In FIG. 6, gate bus lines G1, G2 . . . G768 in effective display area of the liquid crystal panel are numbered in order from the upper line. The image signal has a portion (upper-image portion) that regards an upper half of the screen image, and a portion (lower-image portion) that regards a lower half of the screen image. In a first sub-frame, the upper-image portion of the image signal selects, line by line, the gate bus lines G1 to G384 (an upper half) in an ascending numerical order at odd-numbered timing pulses. the upper-image portion of the image signal selects, line by line, the gate bus lines G385 to G768 (an lower half) in the ascending numerical order at even-numbered timing pulses (Here, the gate bus lines are numbered in order from the upper part of the chart). Then, in a second sub-frame, the lower portion of the image signal selects the gate bus lines G1 to G384 (the upper half) at the even number timing pulses in the ascending numerical order. The lower portion of the image signal selects the gate bus lines G385 to G768 in the ascending numerical order at the odd-numbered timing pulses. In other words, during one frame time, the timing pulse selects the gate bus line in such an order as G1, G385, G2, G386, . . . , G384, G768 and then selects the gate bus line in such an order as G385, G1, G386, G2 . . . G768, G384.

By carrying out scanning of the output signal at the timing as explained above, the output signal of the image signal is written each pixel of the liquid crystal panel in during the time in which the gate is selected by the odd number timing pulse, meanwhile the clear command signal is written in each pixel of the liquid crystal panel during the time in which the gate is selected by the even number timing pulse (i.e. each pixel of the liquid crystal panel is supplied with (and then controlled in accordance with) (a) the output signal of the image signal during the time in which the gate is selected by the odd number timing pulse and (b) the clear command signal during the time in which the gate is selected by the even number timing pulse).

Figure 7:
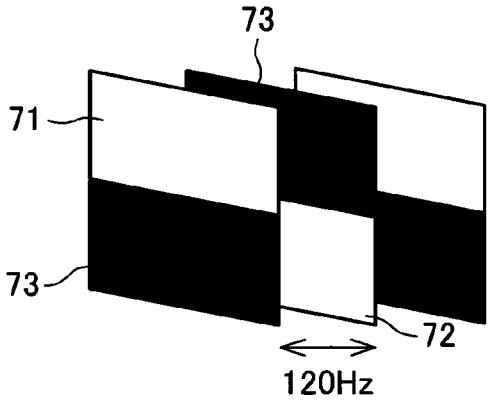
FIG. 7 is a diagram of an image plane displayed by an output signal for each sub-frame in the exemplary embodiment of the present invention.

Accordingly, the writing of the image signal with respect to the whole liquid crystal panel is carried out as is illustrated in FIG. 7. Namely, during the first sub-frame time, an upper half of an image screen is scanned with the upper-image portion of the image signal. At the same time, a lower half of the image screen is scanned with the clear command signal. Thus, the screen image that includes a screen image 71 in the upper half and a black image 73 in the lower half is written in. Then, during the second sub-frame time, the upper half of the image screen is scanned with the clear command signal and the lower half of the image screen is scanned with the lower-image portion of the image signal. Thus, the image that that includes the black image 73 in the upper half and the screen image 72 in the lower half is written in. During the whole frame time that includes the first sub-frame time and the second sub-frame time, a whole screen image and a whole black image are displayed.

In the driving method according to the exemplary embodiment of the present invention as is explained above, a blur in a moving image peculiar to a hold type display is alleviated. Further, trailing of the moving image due to the slow liquid crystal response is also alleviated. As a result, a moving image of high image quality can be displayed.

Embodiment 2

A second exemplary embodiment (exemplary embodiment 2) of the present invention has the same arrangement as the exemplary embodiment 1 except the method of setting an OS parameter table which is looked up by a combination detector circuit 12. How to set the OS parameter table in this exemplary embodiment explained as follows.

As explained above, in one display, voltage Vos (illustrated in FIG. 2), which is given to a pixel, is determined depending on peak transmittance Ta at a steady state and peak transmittance Tb at a steady state. In this exemplary embodiment, voltage out of voltage range corresponding to a gray scale level of an image signal is used as the voltage Vos.

Figure 8:
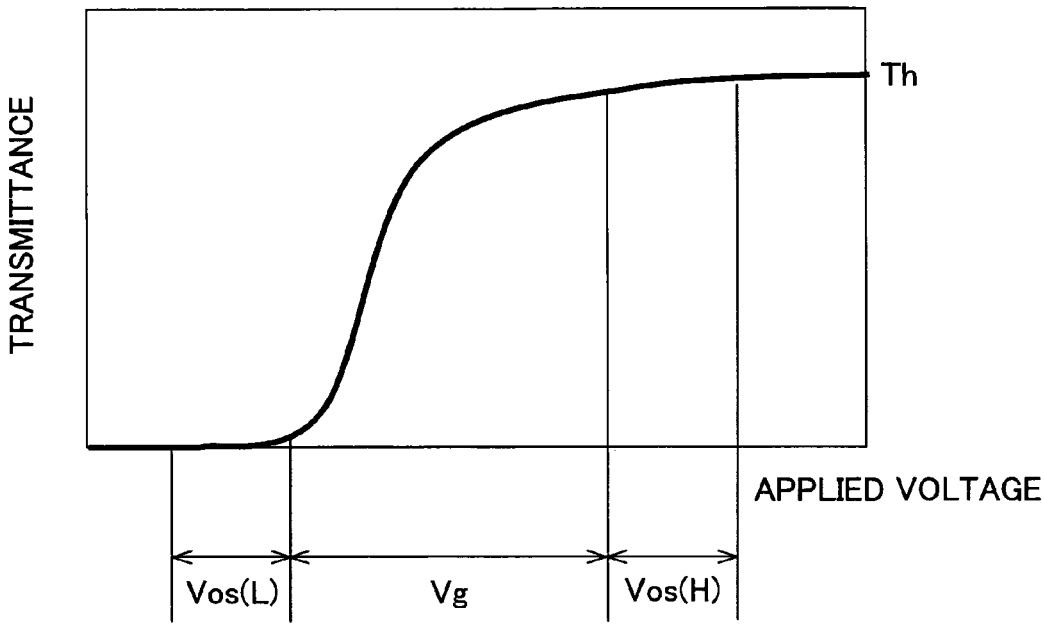
FIG. 8 is a schematic diagram illustrating relation between a liquid crystal transmittance and an applied voltage in the exemplary embodiment of the present invention.

FIG. 8 schematically illustrates relation between transmittance and voltage when a rectangular pulse of a constant voltage is applied to a liquid crystal. FIG. 8 illustrates how the transmittance of the liquid crystal changes in relation to a change in an applied voltage. As illustrated in FIG. 8, the change of the transmittance is in proportion with the change of the applied voltage only within a certain voltage range. At voltages lower than the voltage range, the transmittance is substantially 0 all the time. At voltages higher than the voltage range transmittance is a certain constant value Th substantially. The same is substantially true for a peak transmittance at the steady state. Therefore, here, used as a gray scale voltage Vg corresponding to the image signal is voltage in the certain range in which the liquid crystal transmittance changes in proportion to the change in the applied voltage. However, it is preferable that voltage including voltage out of the range of the voltage Vg be used as the voltage Vos applied in reality, the voltage Vos corresponding to a corrected image signal. Because of this, a higher/lower voltage than a gray scale voltage used for display can be used in order to display a moving image. Thus, it is possible to choose a most appropriate voltage value even when measurement tells the voltage value out of the range of the voltage Vg is preferable as the voltage corresponding to the corrected image signal. Even if such a setting is used, there may be a case in which the peak transmittance at the steady state cannot be substantially a constant value because an applied voltage in a possible range of applied voltages is too low due to restriction by a source driver and the like. In such a case, response speed can be improved by arranging such that the range of the gray scale voltages is lower than a maximum voltage possibly applied, and Vos is higher than the gray scale voltage. This further alleviates the trailing of the moving image due to a slow liquid crystal response, thereby attaining the moving image of high image quality.

As to more specific setting, the voltage Vos for OS driving is predetermined accurately, in the same way as the exemplary embodiment 1, by measuring voltages Vos for the OS driving for each combination of Va and Vb, the voltage Vos allowing to attain the peak transmittance Tb of the voltage Vb at the steady state before an end of an image signal scanning period of the present frame time (a target transmittance during the present frame time).

A method for measuring the voltage Vos for each combination of Va and Vb is explained as follows. Here a gray scale signal used for the image signal is supposed to be 256 gray scale levels from the gray level 0 to the gray level 255. First, all the voltage value range used, including the voltage Vos exclusive to the OS driving and the gray scale voltage Vg, is divided into 1024 scale levels from a scale level 0 to a scale level 1023. Of the 1024 scale levels, a range from the scale level 96 to the scale level 960 is allotted to gray scale data of 256 gray scale levels that correspond to the image signal. Then, voltage Vos for the OS driving is measured, so that, by the voltage Vos, a change in the range of the gray scale levels from the gray level 96 to the gray level 960 can be accurately reflected to the change in the peak liquid crystal transmittance at the steady state. At this time, the scale levels from the scale level 0 to the scale level 95 and scale levels from the scale level 961 to the scale level 1023 are used as the voltage Vos for the OS driving. After these 1024 scale levels are converted to all the 256 gray scale levels from the gray level 0 to the gray level 255 by gray scale extension technology, the gray scale levels are stored in the parameter table.

The OS parameter table, in the same way as the exemplary embodiment 1, is a 9×9 matrix and stores OS parameters for each combination between the image signals of the preceding frame for 9 gray scale levels and the image signals of the present frame for the 9 gray scale levels (the 9 gray scale levels are every 32 gray scale levels (gray levels 0, 32, 64 . . . )). Moreover, a gray scale level other than the 9 gray scale levels (which are every 32 gray scale levels) can be figured out based on the formula (1) using the value in this table.

By carrying out driving by using the OS parameter mentioned above, a blur peculiar to a hold type display can be improved. Moreover, because a higher/lower voltage than the gray scale voltage can be used for displaying the moving image, a problem that necessary high voltage cannot be applied due to the restriction in setting the gray scale voltage to be higher than the gray scale level can be resolved. Furthermore, the trailing of the moving image due to the slow liquid crystal response can be further alleviated. Thus, the moving image of high image quality can be attained.

Embodiment 3

A third exemplary embodiment of the present invention employs a different method of setting a gamma value of a liquid crystal panel. Thus, the method is explained as follows, discussing a case in which a desirable gamma value is 2.2 by way of example.

In this exemplary embodiment, when a preceding image signal and a present image signal take the same gray scale level (i.e., particularly when a still image is displayed), a corrected image signal is not generated but an input signal is outputted as it is.

In order to set the gamma value of the liquid crystal panel, first, voltages for all the 256 gray scale levels from the gray level 0 (black) to the gray level 255 (white) are temporally predetermined at voltages ranging between 1.6V and 7.1V. Then an applied voltage corresponding to the image signal is adjusted so that the gamma value of 2.2 is taken for gray scale/transmittance characteristics concerning the gray scale level of the image signal and the peak transmittance corresponding to the gray scale level at a steady state.

Next, as illustrated in FIG. 9(*a*), voltage Va and voltage V0 corresponding to a clear command signal are alternatively applied every 1/120 second. In this exemplary embodiment, polarity of a gray scale voltage is ignored for convenience and the gray scale voltage is denoted simply as Va, V0, Vb and the like. FIG. 9(*a*) illustrates voltage value outputted from a source driver and transmittance corresponding to the voltage. At this time transmittance of a liquid crystal goes up and down steadily between Ta and T0', drawing a 60 Hz waveform (the steady state). Ta is peak transmittance here. To be more specific, the transmittance increases gradually when Va is applied and reaches Ta before an image signal scanning period ends. Then, when the voltage V0 corresponding to the clear command signal is applied during a clear command signal scanning period, the transmittance is decreased toward T0. When the clear command signal scanning period ends and the image signal scanning period starts, Va is applied again and the transmittance gradually increases. Before the image signal scanning period ends, the transmittance reaches Ta. This process is repeated.

An average value of transmittance T(ave)a is calculated out for every one frame time (16.7 msec) in this repetition. T(ave)a is put as "set transmittance". A corrected voltage corresponding to the image signal is set to be voltage with which the gamma value 2.2 will be attained in the gray scale/transmittance relation of a certain gray scale level and T(ave)a. In this way, relation between the gray scale voltage and the average transmittance of one frame at the steady state are set so that the gamma value is set to take the gamma value 2.2.

In other words, the corrected voltage is predetermined for a gray scale level so that the relation between that gray scale level and the average transmittance at the steady state has a desirable gamma value. That is, by measuring the average transmittance of one frame time by repeatedly applying the voltage corresponding to the image signal of a certain gray scale level and the voltage corresponding to the clear command signal, the corrected voltage is predetermined so that a gray scale/transmittance characteristic between the gray scale level corresponding to the image signal and the average transmittance of one frame time will take the desirable gamma value.

Determination of the OS parameter is carried out as follows: in case the preceding image signal and the present signal have different gray scale levels, a most appropriate voltage Vos is figured out according to the combination between the voltage Va and the voltage Vb as is illustrated in FIG. 9(*b*), the most appropriate voltage Vos promoting a gray scale transition pattern from initial liquid crystal alignment (transmittance T0') of the present frame time to steady-state peak transmittance Tb corresponding to the image signal of the present frame time.

In this exemplary embodiment, it is clear from FIG. 9(*a*) and FIG. 9(*b*) that, when a first image signal and a second image signal are the same, the gray scale level of the image signal is outputted without correction. Thus, the uncorrected image signal may be stored in a corresponding part of the OS parameter table and used so that the image signal of the present frame will be outputted without correction when the preceding image signal and the present image signal have the same gray scale level. More specifically, for example, when the image signal of the preceding frame is S32 and the image signal of the present frame is S32, the value to be looked up by the OS parameter is set at 32 and an uncorrected image signal is outputted. Then, the corrected voltage set in a manner mentioned above is outputted, the corrected voltage corresponding to an uncorrected image signal. (In the exemplary embodiments 1 and 2 of the present invention, as shown in FIG. 3, when the first image signal is S32 and the second image signal is S32, S48 is outputted as a corrected image signal.)

In this exemplary embodiment, when the first image signal and the second image signal are the same in applying voltage on the liquid crystal panel 18, the corrected voltage is controlled so that the corrected voltage is applied to the image signal.

The gamma value of set transmittance is not limited to 2.2. It is possible to choose a preferable value for the gamma value, for example, in a range from 2.0 to 2.8. Further it is more preferable to set the gamma value in a range from 2.1 to 2.6 in consideration of user's preference and driving characteristic. In the use of recent high definition televisions and monitors, display of high precision is required at lower gray scale level side (lower voltage side in a normally black mode). Therefore, it is preferable to set the gamma value substantially 2.4 that is bigger than 2.2. When the gamma value is set by the gray scale level and the average transmittance as in this exemplary embodiment, it is preferable to make the gamma value bigger so that precision of the part becomes higher, because the voltage corresponding to the lower gray scale level side is frequently used relatively compared to the case in the exemplary embodiments 1 and 2 of the present invention in order to display a screen image.

By the present exemplary embodiment, a blur in a moving image peculiar to a holding type display is alleviated as in the exemplary embodiment 1. Further, by setting the gamma value in a manner mentioned above, it is possible to attain more specific gray scale display of the screen image at either of a higher gray scale level side or a low gray scale level side. Moreover, in this exemplary embodiment, when the static image is displayed (when the first image signal and the second image signal are the same), the gray scale level of the corrected image signal is not corrected. Therefore, even when the image signal is distorted under noise disturbance, the distortion is not emphasized by correction. (On the other hand, in the case, as in the exemplary embodiments 1 and 2, the gray scale value of the corrected image signal is corrected even when the static image is displayed, the gray scale level value of the image signal is also corrected. This results in emphasizing the inaccuracy in the gray scale level and it becomes impossible to display a desired screen image.) Accordingly, moving image display of high image quality as well as a rich screen image representation of a low gray scale level side are attained. Moreover, in displaying a static image, noise resistance becomes strong, thereby attaining more natural screen image representation.

The exemplary embodiment of the present invention discuses the homeotropic liquid crystal display device in the NB mode as an example. However, the present invention is not limited to the homeotropic liquid crystal display device in the NB mode. The present invention is applicable to other types of display devices, for example, a homogeneous liquid crystal display device in a normally black mode or a normally white mode liquid crystal display device including a homeotropic liquid crystal layer and a homogeneous liquid crystal layer, and other display devices.

The exemplary embodiment discussed the liquid crystal display device employing the progressive driving method in which one frame is equivalent to one vertical period. However, the present invention is not limited to the liquid crystal display device employing the progressive driving method. The present invention is applicable to a liquid crystal display device employing an interlace driving method in which one field is equivalent to one vertical period.

Further, an optical characteristic of the liquid crystal display device in this exemplary embodiment of the present invention is explained based on transmittance of the liquid crystal panel. However, no need to say, the optical characteristic may be described by luminance in which properties of a backlight unit is taken into consideration.

Moreover, the present invention is not limited to the voltage value and the gamma value specifically stated in this exemplary embodiment.

Further, the liquid crystal display device of the present invention may be a first liquid crystal display device having a following arrangement.

A first liquid crystal display device includes a liquid crystal panel and a driving circuit. The panel includes a liquid crystal layer and an electrode for applying voltage to the liquid crystal layer. The driving circuit divides one frame into sub-frames and applies, during one frame time, voltage corresponding to an image signal and a clear command signal. The driving circuit also includes a table in which a target gray scale level whose target is completing an optical response of the liquid crystal panel from a state of alignment corresponding to voltage value of the clear command signal within a sub-frame according to a combination of an preceding image signal inputted during a vertical period right before the present vertical period and the present image signal inputted during the present vertical period. In the liquid crystal display device, referring to the table, an image signal inputted during the present vertical period is corrected.

In addition to the above arrangement, the first liquid crystal display device may be arranged such that the driving circuit applies, to the liquid crystal panel, voltage out of voltage range used for gray scale display according to a correction of the input image signal.

In addition to the above arrangement, the first liquid crystal display device may be arranged such that the liquid crystal panel is so arranged that a gamma value is set based on a gray scale level and stable transmittance of one frame time, the stable transmittance being for a case where the voltage corresponding to the clear command signal and the voltage corresponding to the image signal are applied.

Embodiment 4

This exemplary embodiment of the present invention is substantially the same as the exemplary embodiment 1 except that a different method of assigning a gate bus line is employed. Namely, a circuit configuration of a liquid crystal display device in this exemplary embodiment is the same as FIG. 1 and a panel structure and the like are also the same as the exemplary embodiment 1, but the method of assigning the gate bus line is different. In the explanation, for convenience, sections that have the same function as the sections in the exemplary embodiment 1 are labeled in the same manner and their explanation is omitted.

The method of assigning the gate bus line in this exemplary embodiment is explained below, referring to a timing chart in FIG. 15.

Figure 15:
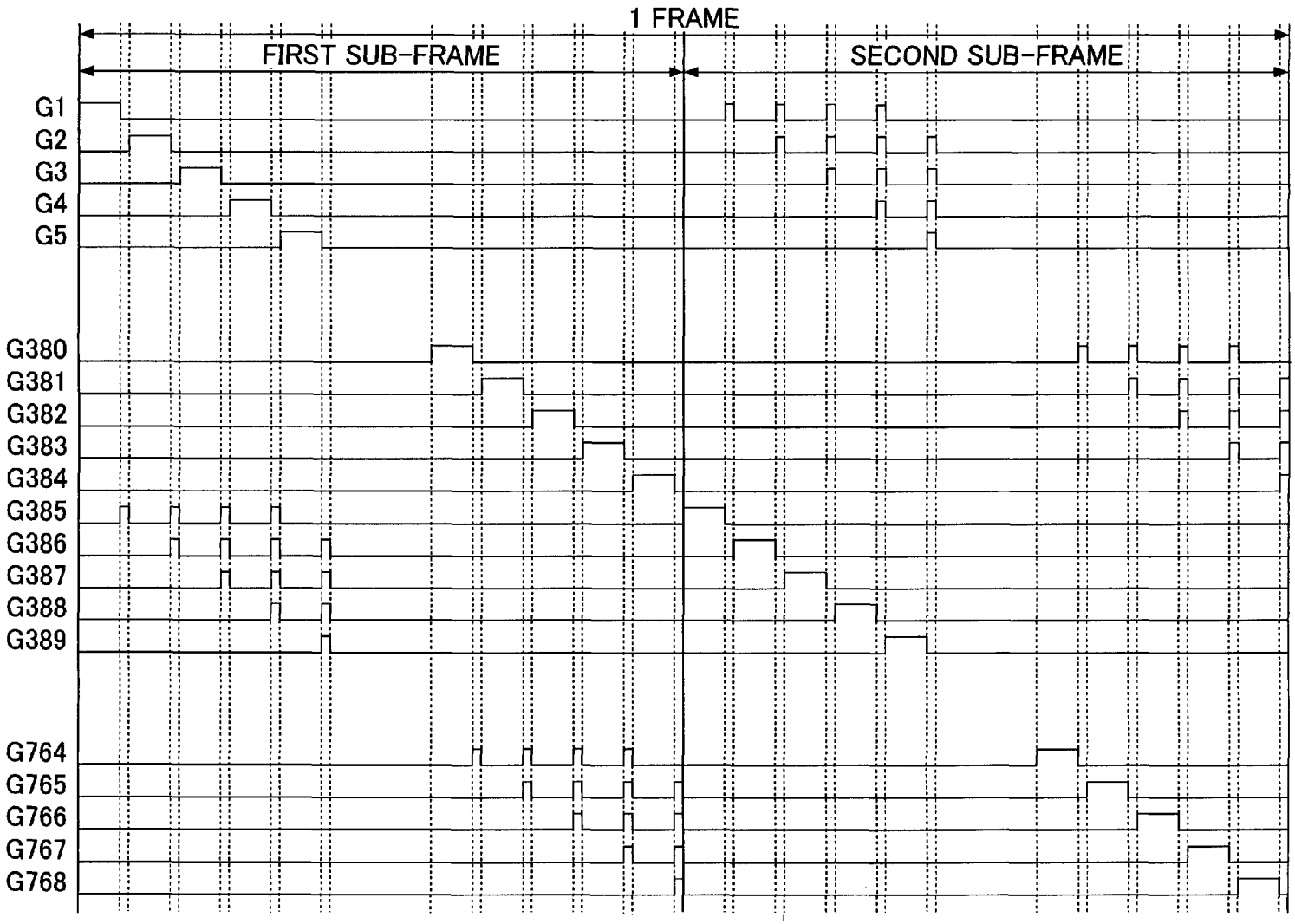
FIG. 15 is a timing chart illustrating an example of timing of selecting a gate bus line according to the exemplary embodiment of the present invention.

In this exemplary embodiment, gate bus lines G1, G2, . . . , G768 (numbered in order from the upper part of the chart) in effective display area of a liquid crystal panel are selected as follows, as is illustrated in FIG. 15. During a first sub-frame time, G1-G384 in an upper half of the gate bus lines are selected an ascending numerical order at odd-numbered timing pulses. Regarding G385-G768 in a lower half of the gate bus lines are selected in the ascending numerical order by four successive even-numbered timing pulses. During the second sub-frame time, G385-G768 in the lower half are selected in the ascending numerical order by the odd number timing pulse. G1-G384 in the upper half are selected in the ascending numerical order by the four successive even-numbered timing pulses.

To be more specific, as illustrated in the FIG. 15, during the first sub-frame, first an odd-numbered timing pulse selects the gate bus line G1 and an image signal is written (i.e. supplied) therein. Next, an even-numbered timing pulse that follows the odd numbered timing pulse selects the gate bus line G385 and a clear command signal is written therein. Then a next odd-numbered timing pulse selects the gate bus line G2 and the image signal is written therein. Then, an even-numbered timing pulse that follows the next odd-numbered timing pulse selects the gate bus lines G385 and G386 at the same time and the clear command signal is written therein. Next, a further next odd-numbered timing pulse selects the gate bus line G3 and the image signal is written therein, and an even-numbered timing pulse that follows the further next odd-numbered timing pulse selects the gate bus lines G385, G386 and G387 at the same time and the clear command signal is written therein. Further, a still further next odd-numbered timing pulse selects the gate bus line G4 and the image signal is written therein, and an even-numbered timing pulse that follows the still further next odd-numbered timing pulse selects the gate bus lines G385, G386, G387, and G388 at the same time and the clear command signal is written therein. Subsequently a yet still next odd-numbered timing pulse selects the gate bus line G5 and the image signal is written therein, and an even-numbered timing pulse that follows the yet still next odd-numbered timing pulse selects the gate bus lines G386, G387, G388, and G389 at the same time and the clear command signal is written therein. Thereafter the same kind of operation is repeated in turn until an odd-numbered timing pulse selects the gate bus line G384 and the image signal is written therein, and an even-numbered timing pulse that follows this odd-numbered timing pulse selects the gate bus lines G765, G766, G767, and G768 at the same time and the clear command signal is written therein.

In the second sub-frame, first an odd-numbered timing pulse selects the gate bus line G385 and the image signal is written therein, and an even-numbered timing pulse that follows the odd-numbered timing pulse selects the gate bus line G1 and the clear command signal is written therein. Then, a next odd-numbered timing pulse selects the gate bus line G386 and the image signal is written therein. An even-numbered timing pulse that follows the next odd-numbered timing pulse selects the gate bus lines G1 and G2 at the same time and the clear command signal is written therein. Moreover, a further next odd-numbered timing pulse selects the gate bus line G387 and the image signal is written therein, and an even-numbered timing pulse that follows the further next odd-numbered timing pulse selects the gate bus lines G1, G2 and G3 at the same time and the clear command signal is written therein. Further a still further next odd-numbered timing pulse selects the gate bus line G388 and the image signal is written therein, and an even-numbered timing pulse that follows the still further next odd-numbered timing pulse selects the gate bus lines G1, G2, G3, and G4 at the same time and the clear command signal is written therein. Subsequently a yet further next odd-numbered timing pulse selects the gate bus line G389 and the image signal is written therein, and an even-numbered timing pulse that follows the yet further next odd-numbered timing pulse selects G2, G3, G4, and G5 at the same time and the clear command signal is written therein. Thereafter the same kind of operation is repeated in turn until an odd-numbered timing pulse selects the gate bus line G768 and the image signal is written therein, and an even-numbered timing pulse that follows this odd-numbered timing pulse selects the gate bus lines G381, G382, G383, and G384 at the same time and the clear command signal is written therein.

By carrying out scanning of an output signal at the timing mentioned above, each pixel of the liquid crystal display device receives the image signal of the output signal during a gate selection period in which the gate bus lines are selected by the odd number timing pulses, and receives the clear command signal during a gate selection period in which the gate bus lines are selected by the even-numbered timing pulses.

Accordingly, during the first sub-frame time, an upper half of an image screen is scanned with the image signal corresponding to an upper half portion of the screen image and at the same time at a lower half of the image screen is scanned with the clear command signal. During the second sub-frame time, the lower half of the image screen is scanned with the image signal corresponding to a lower half portion of the screen image and at the same time the upper half of the image screen is scanned with the clear command signal. Namely, for the liquid crystal panel as a whole, a half of one frame is an image signal scanning period and another half of one frame is a clear command signal scanning period.

In this exemplary embodiment, the gate selection period for the even-numbered timing pulses, that is, the gate selection period during which the clear command is written in, is supposed to be of 1/7 length of the gate selection period for the odd-numbered timing pulse, that is, the gate selection period during which the image signal is written in. However, a ratio the gate selection period during which the image signal is written in and the gate selection period during which the clear command is written in is not limited to this, and may be set arbitrarily.

OS parameter table data stored in a OS parameter table 13 is predetermined in the same manner as the exemplary embodiment 1, that is, by measuring the most appropriate voltage Vos that promotes a gray scale transition pattern from initial liquid crystal alignment of a present frame time to liquid crystal alignment corresponding to an image signal of the present frame time. However, it is preferable to carry out the measurement of the most appropriate voltage Vos by driving the liquid crystal display device in the driving method mentioned in this exemplary embodiment.

By using the driving method mentioned above in this exemplary embodiment, a blur in a moving image peculiar to a hold type display is alleviated. Moreover, trailing of a moving image due to the slow liquid crystal response is also alleviated. As a result, it becomes possible to display the moving image of high image quality.

The explanation above discusses the case where, in the liquid crystal panel as a whole, a half of one frame is the image signal scanning period and another half of one frame is the clear command signal scanning period. However the method of driving the liquid crystal display device according to this exemplary embodiment is not limited to this. Namely, in the liquid crystal panel as a whole, the image signal scanning period and the clear command signal scanning period may have different lengths. One example of the driving method in this case is explained, referring a timing chart in FIG. 16.

Figure 16:
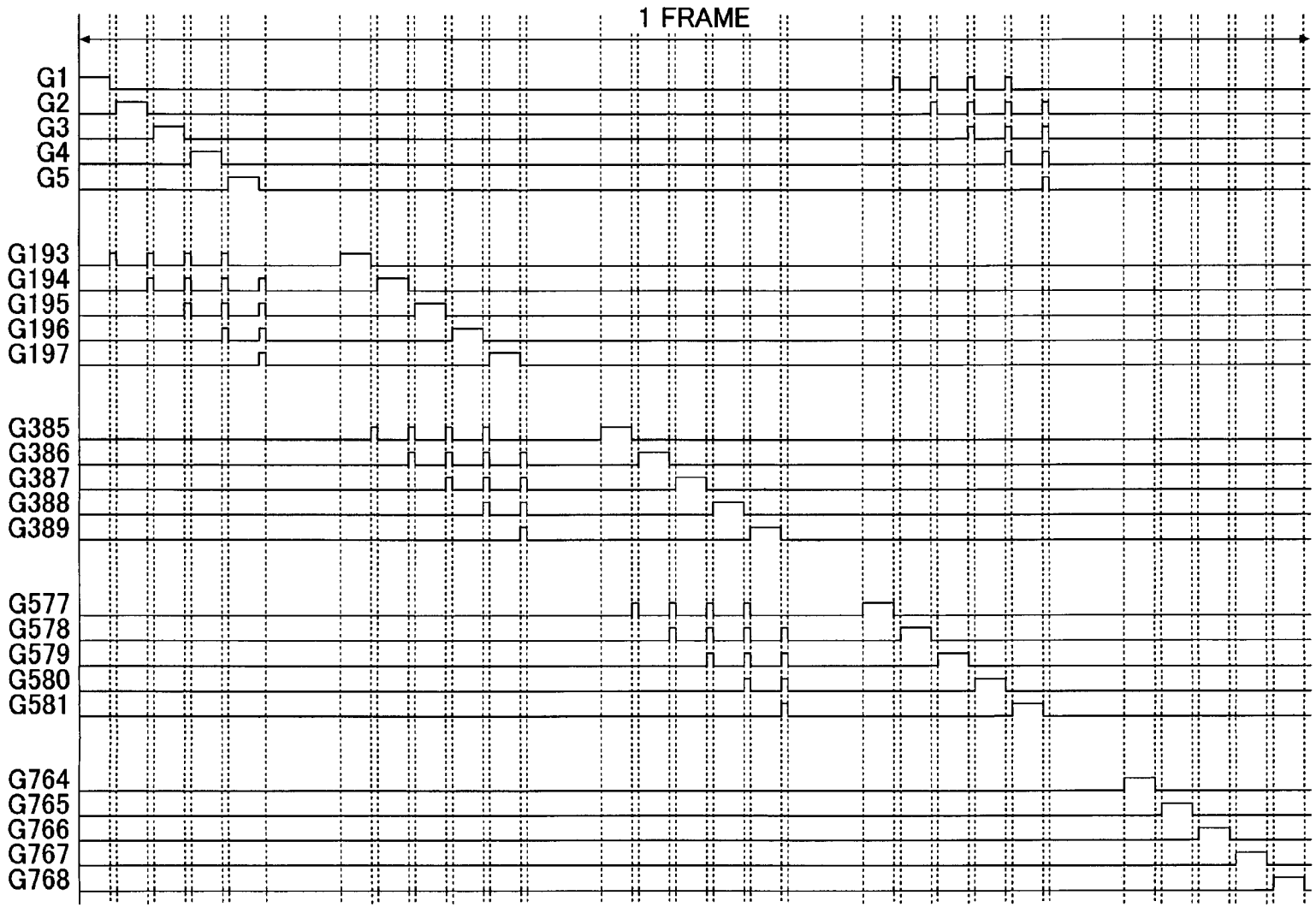
FIG. 16 is a timing chart illustrating an example of timing of selecting a gate bus line according to the exemplary embodiment of the present invention.

In FIG. 16, gate bus lines G1, G2 . . . G768 in effective display area of the liquid crystal panel are numbered in order from the upper line. In the driving method illustrated in FIG.

16, during each frame time, the odd-number timing pulses select the line in ascending numerical order and the image signal is written therein. Here, even number timing pulses selects the gate bus lines G193, G194, . . . , G768, G1, G2, . . . , G192 in the effective display area of the liquid crystal panel in order and the clear command signal is written therein. Each gate bus line is selected four times by the even number timing pulse in order to write the clear command signal therein.

Namely, as is illustrated in FIG. 16, during each frame time, first an odd-numbered timing pulse selects the gate bus line G1 and the image signal is written therein, and an even-numbered timing pulse that follows the odd-numbered timing pulse selects the gate bus line G193 and the clear command signal is written therein. Then, a next odd-numbered timing pulse selects the gate bus line G2 and the image signal is written therein and an even-numbered timing pulse that follows the next odd-numbered timing pulse selects the gate bus lines G193 and 194 at the same time and the clear command signal is written therein. Moreover, a further next odd-number timing pulse selects the gate bus line G3 and the image signal is written therein, and an even-numbered timing pulse that follows the further next odd-numbered timing pulse selects the gate bus lines G193, G194 and G195 at the same time and the clear command signal is written therein. Further a still further next odd-numbered timing pulse selects the gate bus line G4 and the image signal is written therein, and an even-numbered timing pulse that follows the still further next odd-numbered timing pulse selects the gate bus lines G193, G194, G195, and G196 at the same time and the clear command signal is written therein. Subsequently a yet further next odd-numbered timing pulse selects the gate bus line G5 and the image signal is written therein, and an even-numbered timing pulse that follows the yet further next odd-numbered timing pulse selects the gate bus lines G194, G195, G196, and G197 at the same time and the clear command signal is written therein. Thereafter the same kind of operation is repeated in turns until an odd number timing pulse selects a gate bus line Gi (i is an integer in a range of 1 to 768) and the image signal is written therein and an even-numbered timing pulse selects gate bus lines from Gi+192 to Gi+195 (when i>576, lines from Gi−576 to Gi−573) at the same time and the clear command signal is written therein.

In the example illustrated in FIG. 16, the gate selection period for the even-numbered timing pulse is supposed to be 1/7 length of the gate selection period for the odd-numbered timing pulse.

When such a driving method is used, in the liquid crystal panel as a whole, 3/4 of one frame is the image signal scanning period and 1/4 of one frame is the clear command signal scanning period. The ratio between the image signal scanning period and the clear command signal scanning period is not limited to the ratio in the example above, but may be set arbitrarily. For example, the image signal scanning period and the clear command signal scanning period may be set accordingly in order to improve the balance between luminance and performance of moving image display.

The ratio between the gate selection period for the odd-numbered timing pulse and the gate selection period for the even-numbered timing pulse may be set arbitrarily. For example, the period may be set so as to ensure charging time for writing each signal in; or the period may be set arbitrarily according to user's will.

As described above, in this exemplary embodiment, it is possible to set the clear command signal scanning period arbitrarily. This makes it possible to improve the balance between luminance and performance of moving image display by setting the clear command signal scanning period appropriately.

Moreover, in this exemplary embodiment, the gate bus lines are selected, in a predetermined number of time, by the timing pulses for writing in the clear command signal. This makes it possible to ensure charging time for writing in the clear command signal.

The present invention mentioned above is not limited to the exemplary embodiments mentioned above, and may be varied within the scope of the following claims. Embodiments attained by suitable combinations of technical means and method disclosed in different embodiments also fall within the technical scope of the present invention.

In order to solve the problem mentioned above, a liquid crystal display device according to the present invention including (a) a liquid crystal panel for carrying out display by voltage application to pixels, each of which has a liquid crystal layer, and (b) a driving circuit for applying, within one frame time, (i) voltages that respectively correspond with image signals and (ii) a voltage that corresponds with a clear command signal, to the pixels of said liquid crystal panel, is arranged such that the driving circuit includes a correcting section for generating corrected image signals according to combination of first image signals for a preceding frame time and second image signals for a present frame time, the corrected image signals thus generated causing liquid crystal orientation in the pixels to be transited from initial orientation of the present frame time to orientation indicated by the second image signals.

Here the "image signal" mentioned above is a signal obtained by dividing a video signal of the display into units by which the signal is supplied to the pixel. The "image signal" indicates one gray scale level. The driving circuit applies, to the pixel, the voltage that makes the liquid crystal orientation that displays a gray scale level of this image signal in the liquid crystal layer. In this way, the gray scale level of the image signal is displayed thereby displaying on the liquid crystal panel the screen image corresponding to the video signal. The display is carried out by applying, to each pixel, different voltages that correspond to the image signals which are different in each one frame time, and changing the voltages in the pixel of the liquid crystal panel in this way. Moreover, the clear command signal at the same voltage is supplied to all pixels in order to clear the image signal.

"A corrected image signal which carries out transition . . . from initial liquid crystal alignment of the present frame time to liquid crystal alignment corresponding to the second image signal" indicates a signal which gives an instruction to apply the voltage for carrying out the transition of the liquid crystal orientation in the pixels to be transited from the initial orientation of the present frame time to the orientation indicated by the second image signals. For example, the signal may indicate the gray scale level chosen from the gray scale level indicated by the image signal, or, the signal generated may be a signal that defines voltage value corresponding directly.

On the other hand, in the liquid crystal display device, in order to improve a display quality level of a moving image, it is widely known that the image signals and the clear command signal are written in by turns. In order to do this, between the period during which the voltage corresponding to the image signals for a certain frame time are applied and the period during which the voltages corresponding to the image signals for the following frame time is applied, the voltages corresponding to clear command signals is applied. In this case, the voltages corresponding to all clear command signals cannot be applied for enough time to attain the same liquid crystal orientation after the application of the voltages corresponding to the clear command signals. Accordingly, the voltages corresponding to the image signals for the following frame time are applied to the liquid crystals having various liquid crystal orientations. This has caused a problem that an image cannot be displayed accurately.

To solve the problem, in the present invention, the transition from the initial liquid crystal orientation initially obtained in the present frame time to the liquid crystal orientation that corresponds to the second image signal is carried out accurately by applying the voltages corresponding to the corrected image signals determined in consideration of the combination of the first image signals for the preceding frame time and the second image signals for the present frame.

Namely, the liquid crystal orientation of the liquid crystal, after the application the voltages corresponding to the clear command signal, varies depending on circumstances because, for an inadequate period of time (i.e. not enough time compared with a predetermined time), the voltages corresponding to the clear command signal have been applied on the liquid crystal in the liquid crystal orientation corresponding to the first image signal of a preceding frame. In other words, the state of liquid crystal orientation after the voltage corresponding to the clear command signal is applied varies depending on the values of the first image signals of the preceding frame. Accordingly, the liquid crystal orientation certainly becomes the same after the voltages corresponding to the same image signals are applied and then the voltage corresponding to the clear command signal is applied. Thus, by generating the corrected image signal in consideration of not only the second image signal but also the first image signal, the liquid crystal orientation corresponding to the second image signal can be accurately attained.

A liquid crystal display device of the present invention is arranged such that the corrected image signals are based on correspondence between gray scales and voltages capable of carrying out transition of the liquid crystal orientation to (a) the orientation indicated by the second image signals, from (b) orientation right after a predetermined period in which the clear command signal is written in and stored, in liquid crystals that have orientation indicated by the first image signals.

Here, the "predetermined period" is a clear command signal scanning period in an employed liquid crystal driving method. For example, the period is 8.4 msec when the clear command signal is written in and stored for a half of the ordinary frame time.

As mentioned above, the present invention applies a predetermined voltage corresponding to the clear command signal to the liquid crystal oriented corresponding to the first image signal and then the voltage corresponding to the corrected image signal is applied so that the liquid crystal orientation comes to be the orientation that corresponds to the second image signal. In a liquid crystal display device the clear command signal scanning period is constant. A liquid crystal display device may be arranged such that, as the corrected image signal corresponding to the combination of the first image signal and the second image signal, the gray scale level is preset (predetermined) based on measurement of the gray scale level that corresponds to the voltage value that causes the liquid crystal orientation to transit to (a) the orientation that corresponds to the second image signal from (b) the orientation caused by writing and storing, in the liquid crystal oriented corresponding to the first image signal, the clear command signal during the constant clear command signal scanning period.

This makes it possible to output the corrected image signal promptly based on the image signal by employing a simple process. The setting of the corrected image signal may be provided for a part of expected combinations of the voltage values for the image signal or the setting may be provided for all the expected combinations.

In a liquid crystal display device of the present invention, said driving circuit further includes a parameter table that stores, in association, (a) combinations of first image signals and second image signals, and (b) corrected image signals corresponding to the combinations; and said correcting section determines a corrected image signal by looking up said parameter table. This makes it possible to output the corrected image signal based on the image signal by using a simple process.

In a liquid crystal display device of the present invention, voltage values corresponding to the corrected image signals respectively have values in a range out of the voltage values corresponding to gray scales used for the image signals.

Because this makes it possible, by the corrected image signal, to apply the voltage value in the range out of the voltage value corresponding to the gray scale level of the image signal used for display, the voltage higher/lower than the voltage corresponding to the image signal can be used for image display. Accordingly, a necessary voltage value can be applied by the corrected image signal.

When liquid crystal alignment needs to be changed on a large scale, it is obvious that applying the voltage in the range out of the voltage value corresponding to the gray scale level of the image signal is necessary. In other words, when a liquid crystal response is slow, a target state of liquid crystal orientation cannot be reached during a scanning period of a certain image signal even when the highest/lowest voltage corresponding to the image signal used for display is applied and it may likely happen to take plural frame times in order to reach the state of the target alignment. In this case, a moving image looks trailing. For example, when a change from the first image signal for black display to the second image signal for white display is made in the liquid crystal display device in a normally black mode, the voltage enough to display white cannot be reached even when the highest voltage in the voltage corresponding to the image signal used for display is applied. Thus, for some frame times the lasting image of black display remains and the moving image looks trailing. In this case, when the corrected image signal corresponds to the voltage value in the range out of the voltage used for display, a higher voltage (i.e., voltage higher than the voltage corresponding to the image signal used for display) can be applied. This makes a number of frames smaller for reaching the target state of the liquid crystal alignment. Accordingly the trailing is alleviated and the moving image display of higher quality can be attained.

A liquid crystal display device of the present invention is arranged such that, if a first image signal and a second image signal are identical image signals, said driving circuit applies a corrected voltage that corresponds to the second image signal; and said corrected voltage is set so that the relation between the second image signal and set liquid crystal transmittance becomes a predetermined gamma value, where an average liquid crystal transmittance in one frame time is set as the set liquid crystal transmittance of the present image signal, the average liquid crystal transmittance predetermined by averaging liquid crystal transmittances obtained by applying, in plural times and respectively for a predetermined period, the corrected voltages and the voltage that corresponds to the clear command signal.

Here, the wording "if a first image signal and a second image signal are identical image signals" means a case when an image signal during the preceding frame time and an image signal of the present frame time are the same, in other words, a case in which an image signal is inputted second time or more (i.e. an image signal identical with a preceding image signal is inputted) where identical image signals are inputted plural times. The term "Predetermined time" indicates, in the same way as mentioned above, the image signal scanning period or the clear command signal scanning period in a liquid crystal driving method used. The "predetermined gamma value" is the gamma value set according to properties of the liquid crystal display device, or according to preference.

This makes it possible to carry two kinds of methods as correcting methods in order to produce the liquid crystal orientation corresponding to the image signal: a method by which the voltage corresponding to the image signal is corrected and applied and a method by which the corrected image signal is generated by correcting the image signal properly. The independent use of these two methods makes it possible to make the liquid crystal alignment corresponding to the image signal with higher precision.

In this case where the first image signal and the second image signal are the same, it is preferable that the correcting section outputs the second image signal having no correction.

When a distortion in the image signal occurs due to disturbance of noise, there is a problem that the distortion is emphasized by generating the corrected image signal. This problem occurs especially when a static image is displayed. However, when the static image is displayed, in other words, when the first image signal and the second image signal holds the same gray scale level, the method of correcting the voltage corresponding to the second image signal makes it possible to prevent the distortion in the image signal from being emphasized because generating the corrected image signal becomes unnecessary and the voltage that has the predetermined gamma value of the relation between the average liquid crystal transmittance and the image signal is given.

In the case that the first image signal and the second image signal have the same gray scale level, the distortion in the image signal will be emphasized if the applied voltage corresponding to the image signal is set so that the gamma value becomes prescribed one based on peak transmittance at a steady state as usual. However, by setting the gamma value based on average liquid crystal transmittance, no emphasis of the distortion in the gray scale level will occur. Accordingly, the static image can be displayed with natural image representation because noise doesn't easily occur in the display of the static image.

Here the term "peak transmittance" is the highest transmittance in the liquid crystal display device in which the voltages corresponding to the image signal and the clear command signal are applied by turns. "Peak transmittance" is also described as liquid crystal transmittance right before the voltage corresponding to the clear command signal is applied. Especially the term "peak transmittance at a steady state" indicates the point where transmittance is the highest during a period in which a transmittance waveform moves up and down steadily in the liquid crystal display device in which the voltage corresponding to the image signal and the clear command signal are applied by turns. In other words, in the state where the transmittance waveform moves up and down steadily, the term "peak transmittance at a steady state" means initial transmittance during the period in which the voltage corresponding to the clear command signal is applied.

A liquid crystal display device of the present invention may be arranged such that, in one frame time, a period A and a period B have different lengths, the period A being a period during which the voltages that respectively correspond to the image signals are written in the pixels of said liquid crystal panel, and the period B being a period during which the voltage that corresponds to the clear command signal is written in the pixels of said liquid crystal panel. Here, "a period during which the voltages that respectively correspond to the image signals are written in the pixels of said liquid crystal panel" (i.e. the period A) is the period during which the pixel into which the voltage corresponding to the image signal is to be written is selected and "a period during which the voltage that corresponds to the clear command signal is written in the pixels of said liquid crystal panel" (i.e. the period B) is the period during which the pixel into which the voltage corresponding to the clear command signal is written is selected.

By the arrangement mentioned above, for example, the length of the period during which the voltage corresponding to the image signal is written in and the length of the period during which the voltage corresponding to the clear command signal is written in may be set properly according to a characteristic of each signal and the like. This makes it possible to ensure a appropriate charging period for each signal.

The liquid crystal display device may be arranged such that the voltage that corresponds to the clear command signal is written into the pixels of said liquid crystal panel plural times within one frame time.

By the arrangement mentioned above, an enough charging period of the voltage corresponding to the clear command signal can be ensured.

The liquid crystal panel mentioned above may be arranged such that, in one frame time, a period C and a period D have different lengths, the period C being a period during which the voltages that respectively correspond to the image signals are written in and stored in the pixels of said liquid crystal panel, and the period D being a period during which the voltage corresponding to the clear command signal is written in and stored in the pixels of said liquid crystal panel. Here the period (period C) during which the voltages that respectively correspond to the image signals are written in and stored in the pixels of said liquid crystal panel is the image signal scanning period. The period (period D) during which the voltage corresponding to the clear command signal is written in and stored in the pixels of said liquid crystal panel is the clear command signal scanning period.

The arrangement above makes it possible to improve the balance between luminance and performance of the moving image display by appropriately setting the length of the period during which the voltage corresponding to each signal is stored.

A method of the present invention of driving a liquid crystal display device, the method comprising the step of writing image signals and a clear command signal into each pixel of a liquid crystal panel within one frame time, is arranged as to include the step of driving the pixels in said liquid crystal display device in accordance with corrected image signals that are generated according to combination of first image signals for a preceding frame time and second image signals for a present frame time, the corrected image signals thus generated causing liquid crystal orientation in the pixels to be transited from initial orientation of the present frame time to orientation indicated by the second image signals.

Because this makes it possible to apply the voltage corresponding to the corrected image signal determined in consideration of the combination between the first image signal for the preceding frame time and the second image signal for the present frame time, the transition to the liquid crystal orientation corresponding to the second image signal can be carried out accurately.

The liquid crystal display device of the present invention realizes more accurate display in order to attain a moving image display of high image quality, the liquid crystal display device arranged such that the voltage corresponding to the image signal and the voltage corresponding to the clear command signal are applied within one frame time. Therefore, the liquid crystal display device is applied suitably to devices such as personal computers, word processors, amusement machines and equipment, television devices and the like, particularly to devices that are required to display a moving image of high image quality.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device, including (a) a liquid crystal panel for carrying out display by voltage application to pixels, each of which has a liquid crystal layer, and (b) a driving circuit for applying, within one frame time, (i) voltages that respectively correspond with image signals and (ii) a voltage that corresponds with a clear command signal, to the pixels of said liquid crystal panel, wherein:

said driving circuit includes a correcting section for generating corrected image signals according to a combination of first image signals for a preceding frame time and second image signals for a present frame time, the corrected image signals causing liquid crystal orientation in the pixels to be transited from an initial orientation of the present frame time to an orientation indicated by the second image signals;

the corrected image signals are based on correspondence between gray scales and voltages capable of carrying out transition of the liquid crystal orientation to the orientation indicated by the second image signals from an orientation right after a period in which the clear command signal is written in and stored in liquid crystals that have orientation indicated by the first image signals;

if a first image signal and a second image signal are different image signals, said driving circuit applies a voltage that corresponds to the corrected image signal;

if a first image signal and a second image signal are identical image signals, said driving circuit applies a corrected voltage that is generated by correcting a voltage corresponding to the second image signal without using the corrected image signal; and said corrected voltage is set so that the relation between the second image signal and set liquid crystal transmittance becomes a gamma value, where an average liquid crystal transmittance in one frame time is set as the set liquid crystal transmittance of the present image signal, the average liquid crystal transmittance being determined by averaging liquid crystal transmittances obtained by applying, in plural times and respectively for a period, the corrected voltages and the voltage that corresponds to the clear command signal.

2. The liquid crystal display device as set forth in claim 1, wherein:

said driving circuit further includes a parameter table that stores, in association, (a) combinations of first image signals and second image signals, and (b) corrected image signals corresponding to the combinations; and said correcting section determines a corrected image signal by looking up said parameter table.

3. The liquid crystal display device as set forth in claim 1, wherein voltage values corresponding to the corrected image signals may respectively have values in a range out of the voltage values corresponding to gray scales used for the image signals.

4. The liquid crystal display device as in claim 1, wherein:

in one frame time, a period A and a period B have different lengths, the period A being a period during which the voltages that respectively correspond to the image signals are written in the pixels of said liquid crystal panel, and the period B being a period during which the voltage that corresponds to the clear command signal is written in the pixels of said liquid crystal panel.

5. The liquid crystal display device as in claim 1, wherein the voltage that corresponds to the clear command signal is written into the pixels of said liquid crystal panel plural times within one frame time.

6. The liquid crystal display device as in claim 1, wherein:

in one frame time, a period C and a period D have different lengths, the period C being a period during which the voltages that respectively correspond to the image signals are written in and stored in the pixels of said liquid crystal panel, and the period D being a period during which the voltage corresponding to the clear command signal is written in and stored in the pixels of said liquid crystal panel.

7. A method of driving a liquid crystal display device, the method comprising the step of writing image signals and a clear command signal into each pixel of a liquid crystal panel within one frame time, the method comprising the step of:

driving the pixels in said liquid crystal display device in accordance with corrected image signals that are generated according to combination of first image signals for a preceding frame time and second image signals for a present frame time, the corrected image signals causing liquid crystal orientation in the pixels to be transited from an initial orientation of the present frame time to an orientation indicated by the second image signals, wherein the corrected image signals are based on correspondence between gray scales and voltages capable of carrying out transition of the liquid crystal orientation to the orientation indicated by the second image signals from an orientation right after a period in which the clear command signal is written in and stored in liquid crystals that have orientation indicated by the first image signals;

if a first image signal and a second image signal are different image signals, said driving circuit applies a voltage that corresponds to the corrected image signal;

if a first image signal and a second image signal are identical image signals, said driving circuit applies a corrected voltage that is generated by correcting a voltage corresponding to the second image signal without using the corrected image signal; and said corrected voltage is set so that the relation between the second image signal and set liquid crystal transmittance becomes a gamma value, where an average liquid crystal transmittance in one frame time is set as the set liquid crystal transmittance of the present image signal, the average liquid crystal transmittance being determined by averaging liquid crystal transmittances obtained by applying, in plural times and respectively for a period, the corrected voltages and the voltage that corresponds to the clear command signal.

* * * * *